US009849679B2

(12) United States Patent
Ogawa

(10) Patent No.: US 9,849,679 B2
(45) Date of Patent: Dec. 26, 2017

(54) LIQUID JETTING APPARATUS, POWER TRANSMISSION APPARATUS, AND RECORDING APPARATUS

(71) Applicant: Brother Kogyo Kabushiki Kaisha, Nagoya-shi, Aichi-ken (JP)

(72) Inventor: Mikio Ogawa, Nagoya-shi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/359,708

(22) Filed: Nov. 23, 2016

(65) Prior Publication Data

US 2017/0144443 A1 May 25, 2017

(30) Foreign Application Priority Data

Nov. 24, 2015 (JP) ..... 2015-228417
Mar. 28, 2016 (JP) ..... 2016-063322

(51) Int. Cl.
*B41J 2/165* (2006.01)

(52) U.S. Cl.
CPC ..... *B41J 2/16505* (2013.01)

(58) Field of Classification Search
CPC ..... B41J 2/16505
See application file for complete search history.

(56) References Cited

U.S. PATENT DOCUMENTS 8,939,562 B2 * 1/2015 Koike ..... B41J 2/16505 347/5
9,085,156 B1 * 7/2015 Kobayashi ..... B41J 2/16511
9,259,933 B1 * 2/2016 Fima ..... B41J 2/16511

FOREIGN PATENT DOCUMENTS

JP H11-138830 A 5/1999
JP 2004-019820 A 1/2004

* cited by examiner

*Primary Examiner* — Lamson Nguyen
(74) *Attorney, Agent, or Firm* — Banner & Witcoff, Ltd.

(57) ABSTRACT

A liquid jetting apparatus includes: a head unit; a cap; a cap lifter moving the cap between a capping position in which the cap makes contact with the head unit and an uncapping position in which the cap is separated from the head unit; a motor; a driven device; a first transmission gear transmitting power of the motor to the cap movement device; a second transmission gear transmitting the power of the motor to the driven device; and a movement gear moving between a position at which the movement gear engages with the first transmission gear and a position at which the movement gear engages with the second transmission gear depending on a rotation direction of the motor. At least one of the first transmission gear and the movement gear is made of a synthetic resin material containing glass fiber.

18 Claims, 22 Drawing Sheets

CONVEYANCE DIRECTION

Fig. 10

| | CRANK GEAR | PLANET GEAR | VALVE DRIVE GEAR |
|---|---|---|---|
| GLASS FIBER | CONTAINED | NOT CONTAINED | NOT CONTAINED |

LEFT ⟷ RIGHT
SCANNING DIRECTION

LEFT ⟷ RIGHT
SCANNING DIRECTION

Fig. 19A

| | CRANK GEAR | PLANET GEAR | VALVE DRIVE GEAR |
|---|---|---|---|
| GLASS FIBER | NOT CONTAINED | CONTAINED | NOT CONTAINED |

Fig. 19B

| | CRANK GEAR | PLANET GEAR | VALVE DRIVE GEAR |
|---|---|---|---|
| GLASS FIBER | CONTAINED | CONTAINED | NOT CONTAINED |

Fig. 19C

| | CRANK GEAR | PLANET GEAR | VALVE DRIVE GEAR |
|---|---|---|---|
| GLASS FIBER | CONTAINED | NOT CONTAINED | CONTAINED |

Fig. 19D

| | CRANK GEAR | PLANET GEAR | VALVE DRIVE GEAR |
|---|---|---|---|
| GLASS FIBER | NOT CONTAINED | CONTAINED | CONTAINED |

Fig. 19E

| | CRANK GEAR | PLANET GEAR | VALVE DRIVE GEAR |
|---|---|---|---|
| GLASS FIBER | CONTAINED | CONTAINED | CONTAINED |

Fig. 20A

| | CRANK GEAR | PLANET GEAR |
|---|---|---|
| CONTENT RATE OF GLASS FIBER | R1 | R2(<R1) |

Fig. 20B

| | CRANK GEAR | VALVE DRIVE GEAR |
|---|---|---|
| CONTENT RATE OF GLASS FIBER | R3 | R4(<R3) |

LIQUID JETTING APPARATUS, POWER TRANSMISSION APPARATUS, AND RECORDING APPARATUS

CROSS REFERENCE TO RELATED APPLICATION

The present application claims priorities from Japanese Patent Application Nos. 2015-228417 and 2016-063322 filed on Nov. 24, 2015 and Mar. 28, 2016, the disclosures of which are incorporated herein by reference in its entirety.

BACKGROUND

Field of the Invention

The present invention relates to a liquid jetting apparatus, a power transmission apparatus, and a recording apparatus.

Description of the Related Art

Japanese Patent Application laid-open No. H11-138830 discloses an ink-jet printing apparatus with a power transmission apparatus that selectively transmits power from a motor to drive targets. In this power transmission apparatus, the motor is rotated normally to swing a planet gear constituting a pendulum transmission gear right, thereby causing the planet gear to engage with a cam gear. The motor is rotated reversely in a state where a cap is in a capping state to swing the planet gear left, thereby causing the planet gear to engage with a gear of a pump roll holder.

SUMMARY

In the ink-jet printing apparatus described in Japanese Patent Application laid-open No. H11-138830, in order to prevent ink in each discharge port from drying, the cap is typically brought into close contact with a printing head during a standby state in which no recording is performed. When recording is performed, the motor is rotated normally in the state where the cap is brought into close contact with the printing head to separate the cap from the printing head. The planet gear described in Japanese Patent Application laid-open No. H11-138830 is configured to selectively engage with any of the cam gear and the gear of the pump roll holder after moving depending on the rotation direction of the motor. This configuration might cause a situation in which some sort of external force is applied on the planet gear in the standby state to disengage the planet gear from the cam gear. When the motor is rotated normally to separate the cap from the printing head in the state where the planet gear is disengaged from the cam gear, movement of the cap is started from a point of time at which the planet gear reaches an engagement position with the cam gear. In that case, the time that elapses before completion of the cap movement is longer than that of a case in which the motor is rotated normally in a state where the planet gear is engaged with the cam gear. As described above, when a drive target is driven in the configuration in which a movement gear such as the planet gear is moved to switch power transmission, the movement gear such as the planet gear might be disengaged from the cam gear transmitting power to the drive target. In that case, the time to engage the cam gear with the movement gear is required. Namely, power transmission is started after the cam gear engages with the movement gear, thereby lengthening the time that elapses before the start of power transmission.

An object of the present teaching is to provide a liquid jetting apparatus, a power transmission apparatus, and a recording apparatus that are capable of reducing, as much as possible, the time that elapses before power transmission to a drive target is started.

According to a first aspect of the present teaching, there is provided a liquid jetting apparatus, including:

a head unit having a liquid jetting surface with nozzles;

a cap configured to cover the nozzles in a state of being in contact with the head unit;

a cap lifter configured to move the cap between a capping position in which the cap is in contact with the head unit to cover the nozzles and an uncapping position in which the cap is separated from the head unit;

a motor;

a driven device;

a first transmission gear connected to the cap lifter and configured to transmit power of the motor to the cap lifter;

a second transmission gear connected to the driven device and configured to transmit the power of the motor to the driven device; and a movement gear connected to the motor and configured to be moved between a position at which the movement gear engages with the first transmission gear and a position at which the movement gear engages with the second transmission gear depending on a rotation direction of the motor, wherein at least one of the first transmission gear and the movement gear is made of a synthetic resin material containing glass fiber.

According to a second aspect of the present teaching, there is provided a liquid jetting apparatus, including:

a head unit having a liquid jetting surface with nozzles;

a cap configured to cover the nozzles in a state of being in contact with the head unit;

a cap lifter configured to move the cap between a capping position in which the cap is in contact with the head unit to cover the nozzles and an uncapping position in which the cap is separated from the head unit;

a motor;

a driven device;

a first transmission gear configured to transmit power of the motor to the cap movement device;

a second transmission gear configured to transmit the power of the motor to the driven device; and a movement gear connected to the motor and configured to be moved between a position at which the movement gear engages with the first transmission gear and a position at which the movement gear engages with the second transmission gear depending on a rotation direction of the motor, wherein a maximum friction force between the first transmission gear and the movement gear obtained in a state where the first transmission gear is engaged with the movement gear is greater than a maximum friction force between the second transmission gear and the movement gear obtained in a state where the second transmission gear is engaged with the movement gear.

According to a third aspect of the present teaching, there is provided a power transmission apparatus, including:

a motor;

a first driven device and a second driven device;

a first transmission gear connected to the first driven device and configured to transmit power of the motor to the first driven device;

a second transmission gear connected to the second driven device and configured to transmit the power of the motor to the second driven device; and a movement gear connected to the motor and configured to be moved between a position at which the movement gear engages with the first transmission gear and a position at which the movement gear engages with the second transmission gear depending on a rotation direction of the motor, wherein a maximum friction force between the first transmission gear and the movement gear obtained in a state where the first transmission gear is engaged with the movement gear is greater than a maximum friction force between the second transmission gear and the movement gear obtained in a state where the second transmission gear is engaged with the movement gear.

According to the first to third aspects, engagement between the first transmission gear and the movement gear is not released easier than engagement between the second transmission gear and the movement gear. Thus, it is possible to shorten the time that elapses before power transmission to the drive target is started as much as possible.

In the present teaching, the wording "connected to the cap movement device" includes not only the case in which the first transmission gear is directly connected to the cap movement device but also the case in which the first transmission gear is connected to the cap movement device via anther gear or the like. The wording "connected to the driven device" includes not only the case in which the second transmission gear is directly connected to the driven device but also the case in which the second transmission gear is connected to the driven device via another gear or the like. Similarly, the wording "connected to the motor" includes not only the case in which the movement gear is directly connected to the motor but also the case in which the movement gear is connected to the motor via another gear or the like.

BRIEF DESCRIPTION OF THE DRAWINGS

FIG. 10 is a diagram indicating a material used in a planet gear, a crank gear, and a valve drive gear, the planet gear selectively engaged with the crank gear and the valve drive gear.

FIG. 19A is a diagram of a first modified example corresponding to FIG. 10, FIG. 19B is a diagram of a second modified example corresponding to FIG. 10, FIG. 19C is a diagram of a third modified example corresponding to FIG. 10, FIG. 19D is a diagram of a fourth modified example corresponding to FIG. 10, and FIG. 19E is a diagram of a fifth modified example corresponding to FIG. 10.

FIG. 20A depicts an exemplary relation between the content rate of glass fiber in the crank gear and the content rate of glass fiber in the planet gear in each of the second and fifth modified examples, and FIG. 20B depicts an exemplary relation between the content rate of glass fiber in the crank gear and the content rate of glass fiber in the valve drive gear in each of the third and fifth modified examples.

DESCRIPTION OF THE EMBODIMENTS

Preferred embodiments of the present teaching will be described below.

<Overall Configuration of Printer>

Figure 1:
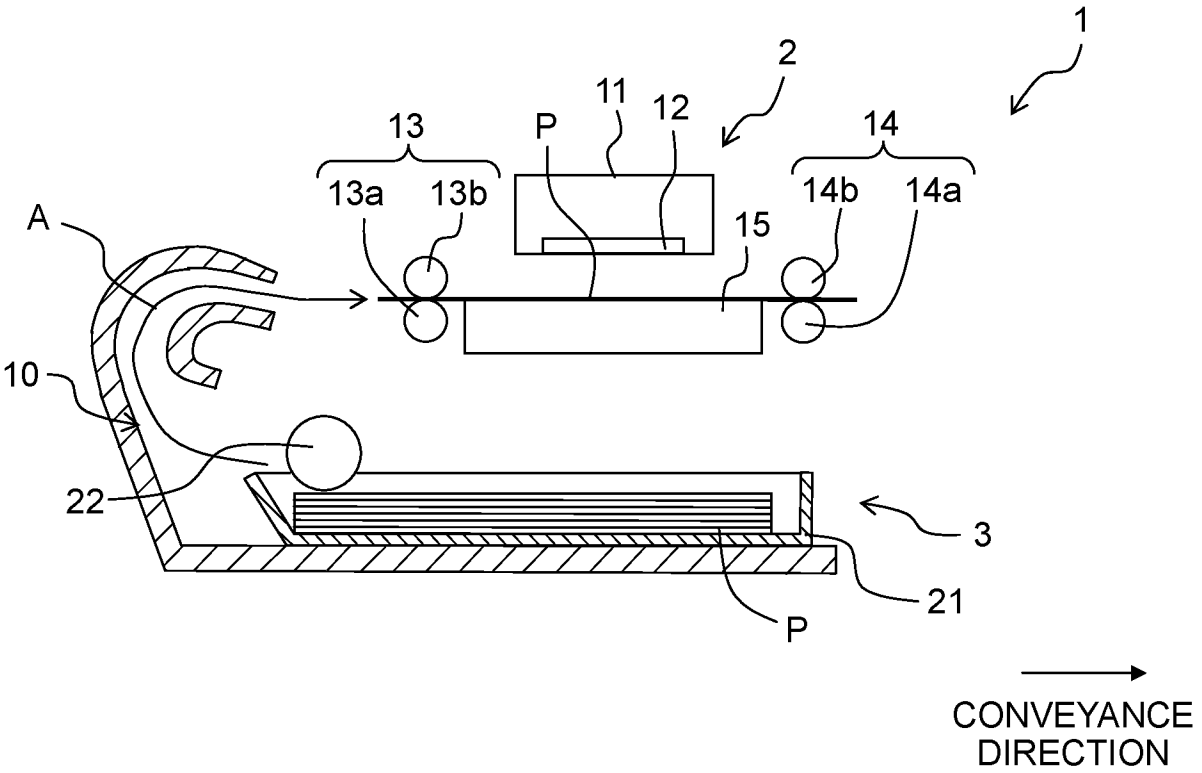
FIG. 1 is a schematic side view of a printer according to an embodiment of the present teaching.
Figure 2:
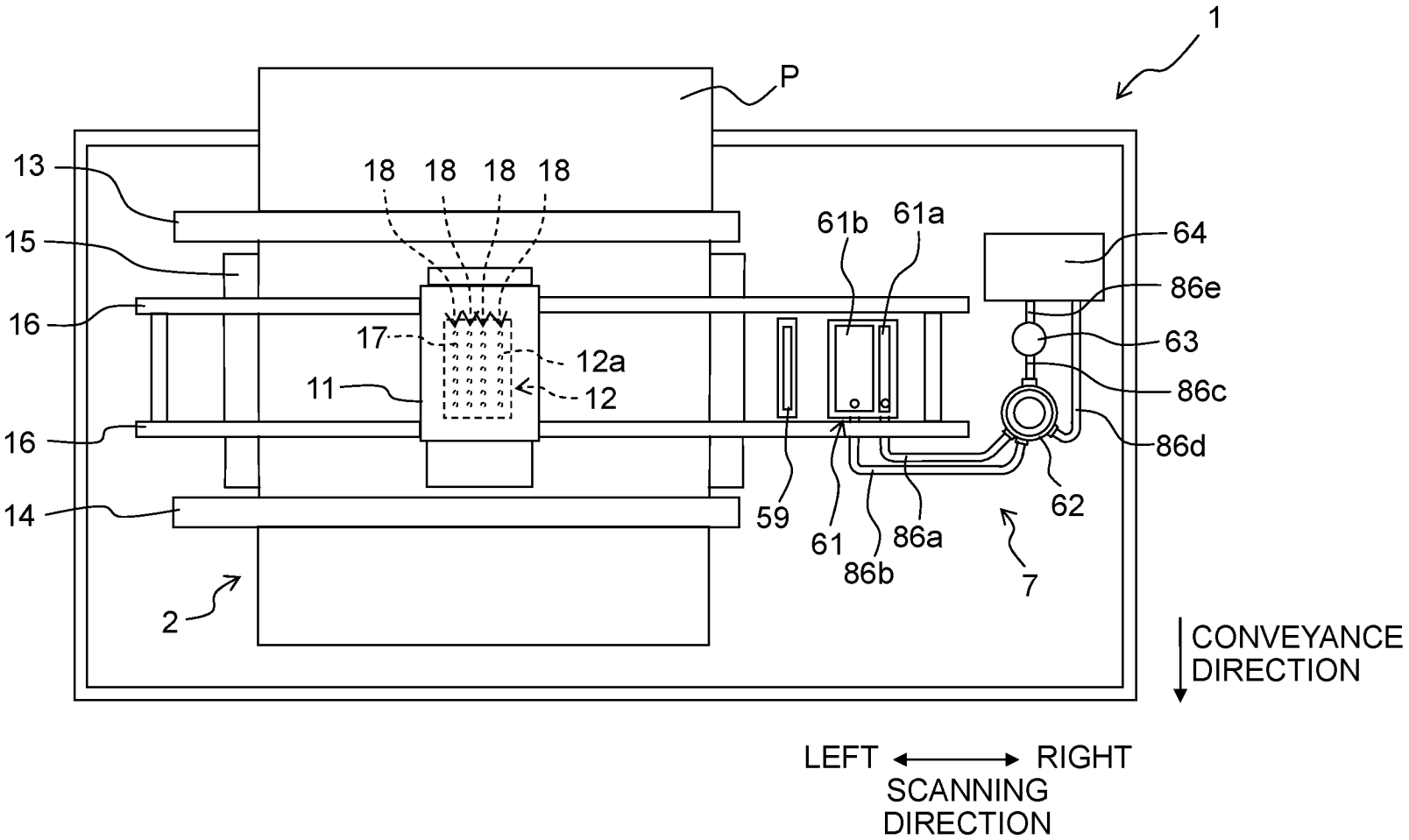
FIG. 2 is a schematic plan view of a printing unit and a maintenance unit.

As depicted in FIGS. 1 and 2, a printer 1 of this embodiment (a "liquid jetting apparatus" of the present teaching) includes, for example, a printing unit 2, a feed part 3, and a maintenance unit 7.

<Printing Unit>

The printing unit 2 includes, for example, a carriage 11, an ink-jet head 12 (a "liquid jetting head" of the present teaching), conveyance rollers 13, 14, and a platen 15. The carriage 11 is movably supported in a scanning direction by two guide rails 16 extending in the scanning direction. The carriage 11, which is connected to a carriage motor 156 (see FIG. 15) via an unillustrated belt and pulley, is driven by the carriage motor 156 so as to reciprocate in the scanning direction. In the following, the right and the left in the scanning direction are defined as indicated in FIG. 2.

The ink-jet head 12, which is carried on the carriage 11, jets ink from nozzles 17 formed in an ink jetting surface 12*a* (a "liquid jetting surface" of the present teaching) which is a lower surface of the ink-jet head 12. The nozzles 17, which are disposed to align in a conveyance direction orthogonal to the scanning direction, form nozzle rows 18. The ink-jet head 12 includes four nozzle rows 18 arranged in the scanning direction. Inks of black, yellow, cyan, and magenta are jetted from nozzles 17 of the four nozzle rows 18 respectively, in the order of the nozzle rows 18 from the right side in the scanning direction. The carriage 11 and the ink-jet head 12 correspond to a "head unit" of the present teaching.

Figure 12A:
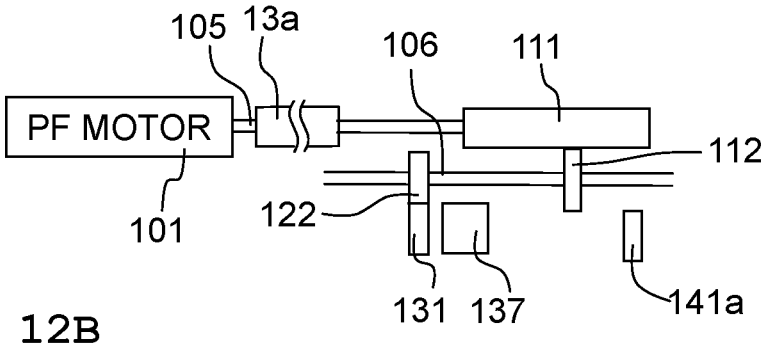
FIGS. 12A to 12C are diagrams each illustrating a connection relation between a PF motor and a feed roller and a PF input gear and a PF switch gear, FIG. 12A depicting a state in which an ASF switch gear is engaged with a feed gear, FIG. 12B depicting a state in which the PF switch gear fails to engage with a pump drive gear and the ASF switch gear is engaged with a selective drive gear, FIG. 12C depicting a state in which the PF switch gear is engaged with the pump drive gear and the ASF switch gear is engaged with the selective drive gear.
Figure 12B:
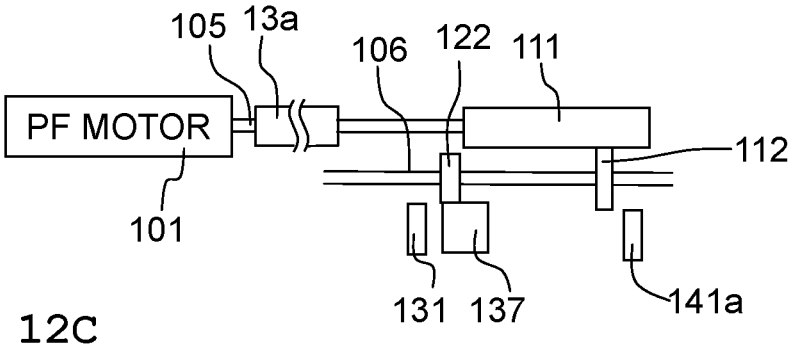

The conveyance rollers 13 are disposed upstream of the carriage 11 in the conveyance direction, which is parallel to the ink jetting surface 12*a* and orthogonal to the scanning direction. The conveyance rollers 13 include a drive roller 13*a* and a driven roller 13*b* disposed on the upper side of the drive roller 13*a*. As will be described later, the drive roller 13*a* is connected to a PF motor 101 (see FIG. 12). Driving the PF motor 101 reversely (counterclockwise) transmits power from the PF motor 101 to the drive roller 13*a*, thereby rotating the drive roller 13*a* in a clockwise direction in FIG. 1. This conveys a recording sheet P in the conveyance direction in a state where the sheet P is nipped by the drive roller 13*a* and the driven roller 13*b*. Driving the PF motor 101 normally (clockwise) rotates the drive roller 13*a* in a counterclockwise direction in FIG. 1.

The conveyance rollers 14 are disposed downstream of the carriage 11 in the conveyance direction. The conveyance rollers 14 include a drive roller 14*a* and a driven roller 14*b* disposed on the upper side of the drive roller 14*a*. The drive roller 14*a* is connected to the drive roller 13*a* via unillustrated gears. Thus, when power is transmitted from the PF motor 101 to the drive roller 13*a*, drive force is transmitted also to the drive roller 14*a* to rotate the drive roller 14*a*. In this situation, the drive rollers 13*a*, 14*a* have the same rotation direction. Accordingly, rotating the PF motor 101 reversely (counterclockwise) conveys the recording sheet P in the conveyance direction in a state where the recording sheet P is nipped by the drive roller 14*a* and the driven roller 14*b*.

The platen 15 is disposed between the conveyance rollers 13, 14 in the conveyance direction to face the ink jetting surface 12*a*. The platen 15 supports, from below, the recording sheet P conveyed by the conveyance rollers 13, 14.

<Feed Part>

The feed part 3 is disposed below the platen 15. The feed part 3 includes a sheet cassette 21 and a feed roller 22. The sheet cassette 21 accommodates recording sheets P stacked vertically. As will be described later, the feed roller 22 is connectable to an ASF motor 102 via gears including a feed gear 131 (see FIG. 12, illustration of the gears is omitted except for the feed gear 131). Rotating the ASF motor 102 normally in a state where the feed roller 22 is connected to the ASF motor 102 transmits power from the ASF motor 102 to the feed roller 22 to rotate the feed roller 22 in the clockwise direction in FIG. 1. This rotation conveys the recording sheet P accommodated in the feed cassette 21 toward the upstream side in the conveyance direction. A supply route 10 is provided upstream of the feed cassette 21 in the conveyance direction to guide the recording sheet P fed from the downstream side in the conveyance direction to a position upstream of the conveyance rollers 13 in the conveyance direction. The recording sheet P conveyed by the feed roller 22 is conveyed upstream of the conveyance rollers 13 in the conveyance direction along the supply route 10 and then supplied to the printing unit 2, as indicated by an arrow A1 in FIG. 1.

<Maintenance Unit>

Subsequently, the maintenance unit 7 will be explained. As depicted in FIGS. 2 to 11, the maintenance unit 7 includes a wiper 59, a nozzle cap 61, a switch valve 62 (a "driven device" of the present teaching), a suction pump 63, and a waste liquid tank 64.

<Wiper>

The wiper 59 is disposed on the right of the platen 15. The wiper 59 is moved up and down by a wiper lifting unit 157 (see FIG. 15). The upper end of the wiper 59 is positioned above the ink jetting surface 12*a* in a state where the wiper 59 is raised by the wiper lifting unit 157. When the carriage 11 moves in a state where the wiper 59 is raised, the wiper 59 makes contact with the ink jetting surface 12*a*. Meanwhile, the upper end of the wiper 59 is positioned below the ink jetting surface 12*a* in a state where the wiper 59 is lowered by the wiper lifting unit 157. When the carriage 11 moves in a state where the wiper 59 is lowered, the wiper 59 does not make contact with the ink jetting surface 12*a*.

<Nozzle Cap>

The nozzle cap 61, which is made of a rubber material, is disposed on the right of the wiper 59 in the scanning direction. The nozzle cap 61 includes two caps 61*a* and 61*b*. The caps 61*a* and 61*b* are disposed adjacent to each other such that the cap 61*a* is on the right side of the cap 61*b* in the scanning direction. When the carriage 11 moves to a position where the ink jetting surface 12*a* faces the nozzle cap 61, the rightmost nozzle row 18 overlaps with the cap 61*a* and three nozzle rows 18 on the left of the rightmost nozzle row 18 overlap with the cap 61*b*. The nozzle cap 61 is movable up and down by a cap lifting device 70 as described later. When the cap lifting device 70 moves the nozzle cap 61 upward in a state where the ink jetting surface 12*a* faces the nozzle cap 61, the nozzle cap 61 makes contact with the ink jetting surface 12*a* so that the cap 61*a* covers the rightmost nozzle row 18 and the cap 61*b* covers the three nozzle rows 18 on the left side of the rightmost nozzle row 18.

<Cap Lifting Device>

Figure 3A:
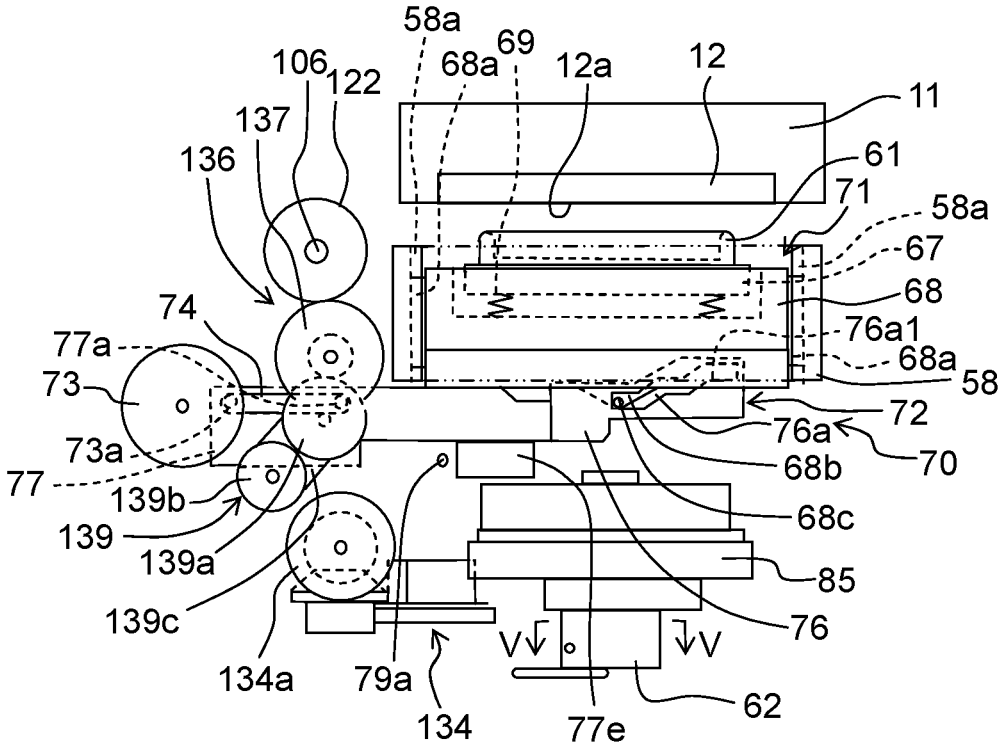
FIG. 3A depicts an arrangement of a cap lifting device, a switch valve, and gears to be connected to them as viewed from the right in a scanning direction.
Figure 3B:
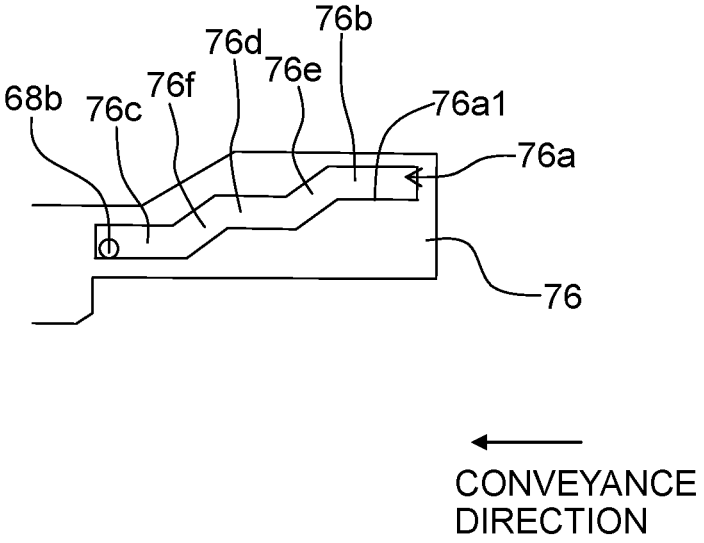
FIG. 3B is an enlarged view depicting surroundings of a groove of a slide cam of FIG. 3A.
Figure 4:
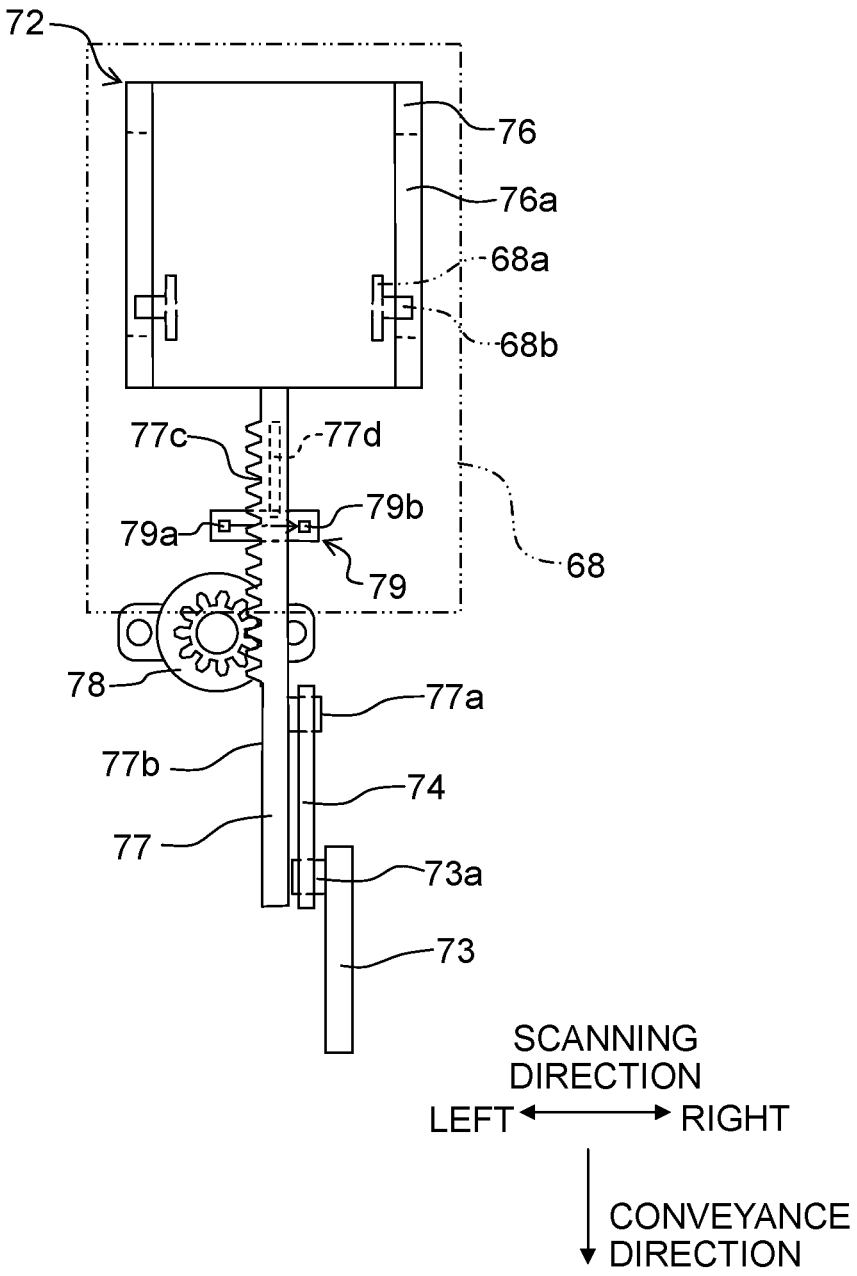
FIG. 4 is a plan view of the slide cam.
Figure 5:
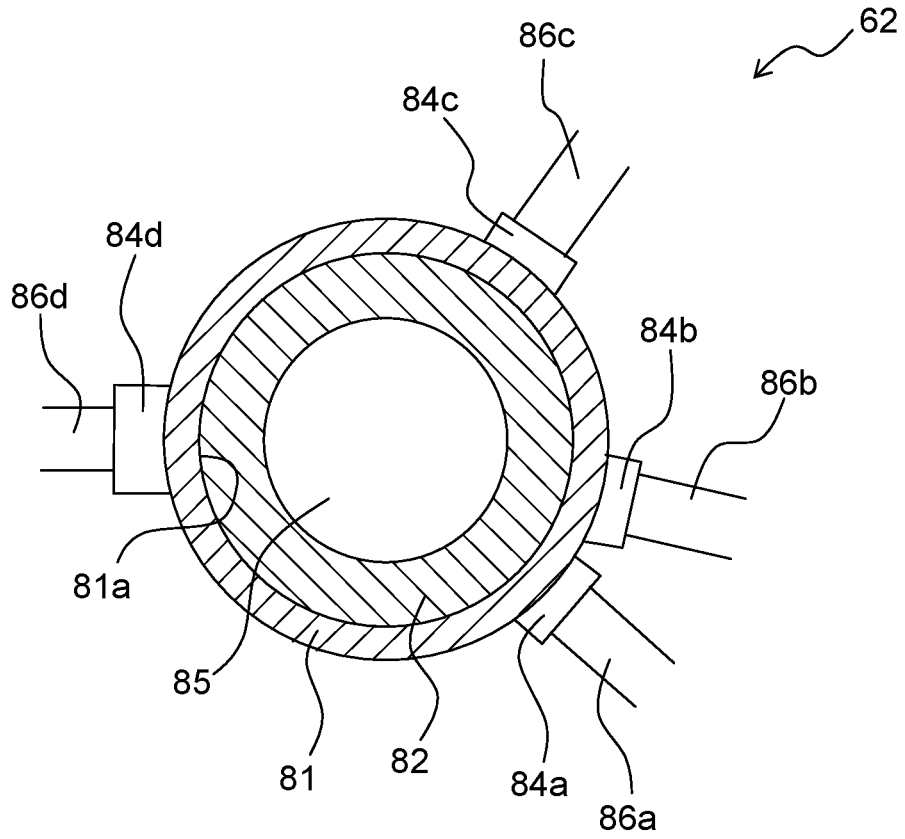
FIG. 5 is a cross-sectional view of the switch valve of FIG. 3A taken along the line V-V.

The cap lifting device 70 moving the nozzle cap 61 up and down (a "cap lifter" of the present teaching) will be explained. As depicted in FIGS. 3 to 5, the cap lifting device 70 includes a cap holding part 71 and a slide cam 72.

The cap holding part 71 includes a cap holder 67, a support member 68, and a spring 69. The cap holder 67, which supports the nozzle cap 61 from below, increases the rigidity of the nozzle cap 61. The support member 68, which is disposed below the cap holder 67, supports the cap holder 67 from below. A guide member 58 is disposed to surround the support member 68. Protruding parts 68*a* extending in an up-down direction are formed at both end surfaces of the support member 68 in the conveyance direction. The guide member 58 has guide grooves 58*a* extending in the up-down direction and engaging with the protruding parts 68*a*. The support member 68 and the nozzle cap 61 supported thereby can move up and down by moving the protruding parts 68*a* of the support member 68 along the guide grooves 58*a*. The guide member 58 is fixed to an unillustrated frame provided in a body of the printer 1.

Protruding parts 68*b* protruding downward are provided in the vicinities of both ends of the lower surface of the support member 68 in the scanning direction. Protruding parts 68*c* extending in the scanning direction are formed at outer side surfaces of the protruding parts 68*b* in the scanning direction, respectively. The spring 69, which is disposed between the cap holder 67 and the support member 68, urges the cap holder 67 upward.

The slide cam 72 includes two parts 76 and 77. The part 76 is disposed below the support member 68 to extend in the conveyance direction. Grooves 76*a* are formed at both ends of the part 76 in the scanning direction. The protruding parts 68*c* of the support member 68 are inserted into the grooves 76*a*, thereby connecting the support member 68 and the slide cam 72. As depicted in FIG. 3B, each groove 76*a* includes three parallel parts 76*b*, 76*c*, and 76*d* and two inclined parts 76*e*, 76*f*. For easy understanding of the structure of the groove 76*a*, the length of the slide cam 72 in the conveyance direction in FIG. 3B is longer than that of FIG. 3A.

The parallel part 76*b* is disposed at an upstream end of the part 76 in the conveyance direction and extends parallel to the conveyance direction. The parallel part 76*c* is disposed below the parallel part 76*b*, disposed downstream of the parallel part 76*b* in the conveyance direction, and extends parallel to the conveyance direction. The parallel part 76*d* is disposed between the parallel parts 76*b*, 76*c* in the conveyance direction and an up-down direction and extends parallel to the conveyance direction. The inclined part 76*e* is disposed between the parallel parts 76*b* and 76*d* in the conveyance direction, extends in the conveyance direction while being inclined thereto, and connects the parallel parts 76*b* and 76*d*. The inclined part 76*f* is disposed between the parallel parts 76*c* and 76*d* in the conveyance direction, extends in the conveyance direction while being inclined thereto, and connects the parallel parts 76*c* and 76*d*. The inclined part 76*e* has the inclined angle relative to the conveyance direction and the length in the conveyance direction that are substantially the same as those of the inclined part 76*f*.

The part 77 is narrower than the part 76 in width and extends downstream in the conveyance direction from the center of the downstream end of the part 76 in the conveyance direction. An arm supporting part 77*a* is provided at the downstream end of the part 77 in the conveyance direction. The arm supporting part 77*a* extends in the scanning direction to support an arm 74 as described later. A gear 77*c* extending in the conveyance direction is formed in a left side surface 77*b* of the part 77 in the scanning direction. The slide cam 72 includes an oil damper 78 engaging with the gear 77*c*. The oil dumper 78 prevents the slide cam 72 from sliding (moving suddenly) in the conveyance direction as will be described later. A protruding part 77*d* extending in the conveyance direction is provided at a part, of the left side surface 77*b* of the part 77 in the scanning direction, which is upstream of the gear 77*c* in the conveyance direction. A guide member is provided on the left of the part 77 in the scanning direction. A groove extending in the conveyance direction is formed on a right surface of the guide member in the scanning direction. The protruding part 77*d* is inserted into the groove of the guide member. Moving the protruding part 77*d* along the groove moves the slide cam 72 in the conveyance direction. The guide member is fixed to an unillustrated frame provided in the body of the printer 1.

The slide cam 72 includes a sensor 79 detecting a position in the conveyance direction. The sensor 79 includes a light emitting element 79*a* and a light receiving element 79*b*. The light emitting element 79*a* is disposed on the left of the part 77 in the scanning direction, and the light receiving element 79*b* is disposed on the right of the part 77 in the scanning direction. The light emitting element 79*a* emits light to the light receiving element 79*b*. The light receiving element 79*b* receives the light emitted from the light emitting element 79*a*. Further, a light blocking part 77*e*, which operates in connection with the sensor 79, is provided in the lower surface of the part 77. Whether or not the light blocking part 77*e* blocks the light emitted from the light emitting element 79*a* is switched when the slide cam 72 moves in the conveyance direction, as described later. The sensor 79 becomes an off state, in which no signal is outputted, when the light receiving element 79*b* receives the light emitted from the light emitting element 79*a*, and the sensor 79 becomes an on state, in which the signal is outputted, when the light receiving element 79*b* does not receive the light emitted from the light emitting element 79*a*. The position of the slide cam 72 and the switching of the sensor 79 between the on and off states will be described later in detail.

The slide cam 72 is connected to the crank gear 73 (a "first transmission gear" of the present teaching) via the arm 74. More specifically, the crank gear 73 is a gear of which axis direction is parallel to the scanning direction. An arm supporting part 73*a* extending in the scanning direction is provided at a part, of a side surface of the crank gear 73, deviated from the center of the crank gear 73. A first end of the arm 74 is swingably supported by the arm support part 77*a* of the slide cam 72 and a second end of the arm 74 is swingably supported by the arm support part 73*a* of the crank gear 73. Accordingly, the slide cam 72 and the crank gear 73 are connected via the arm 74.

<Switch Valve>

As depicted in FIG. 5, the switch valve 62 includes an accommodating member 81 and a channel member 82. The accommodating member 81 is a cylindrical member of which lower end is closed. The accommodating member 81 includes two cap communicating ports 84*a*, 84*b*, an atmosphere communicating port 84*c*, and a pump communicating port 84*d*. The communicating ports 84*a* to 84*d* communicating with an internal space 81*a* protrude outward in a radial direction of the accommodating member 81 in mutually different directions. The cap communicating port 84*a* communicates with the cap 61*a* via a tube 86*a*. The cap communicating port 84*b* communicates with the cap 61*b* via a tube 86*b*. The atmosphere communicating port 84*c* communicates with the waste liquid tank 64 via a tube 86*c*. The pump communicating port 84*d* communicates with the suction pump 63 via a tube 86*d*.

The channel member 82, which is a cylindrical member made of a rubber material, is rotatably accommodated in the internal space 81*a* of the accommodating member 81. The channel member 82 includes, for example, unillustrated grooves forming ink channels to make the communicating ports 84*a* to 84*d* communicate with each other. The channel member 82 is mounted on a valve cam 85. The valve cam 85 is connected to a valve drive gear group 134 including a valve drive gear 134*a* (a "second transmission gear" of the present teaching). The valve drive gear 134*a* is a gear of which axis direction is parallel to the scanning direction. Since the structure of the switch valve 62 is the same as that of conventional ones, the more detailed explanation thereof is omitted.

<Selective Gear Mechanism>

In this embodiment, power can be selectively transmitted from the ASF motor 102 to any one of the cap lifting device 70 and the switch valve 62 via a selective gear mechanism 136. More specifically, as depicted in FIG. 3A, the selective gear mechanism 136 includes a selective drive gear 137 and a planet gear mechanism 139. The selective drive gear 137 is a gear of which axis direction is parallel to the scanning direction. The selective drive gear 137 is engageable with an ASF switch gear 122 as described later. Power from the ASF motor 102 is transmitted to the selective drive gear 137 engaging with the ASF switch gear 122. The planet gear mechanism 139 includes a sun gear 139*a*, a planet gear 139*b*, and a connection member 139*c*. The sun gear 139*a* is a gear of which axis direction is parallel to the scanning direction. The sun gear 139*a* engages with the selective drive gear 137. The planet gear 139*b* is a gear of which axis direction is parallel to the scanning direction. The planet gear 139*b* engages with the sun gear 139*a*. The connection member 139*c* connects the sun gear 139*a* and the planet gear 139*b*. The sun gear 139*a* and the planet gear 139*b* are rotatably supported by the connection member 139*c*. In the planet gear mechanism 139, rotation of the sun gear 139*a* makes the planet gear 139*b* rotate about its own axis and an axis of the sun gear 139*a*. In this situation, the planet gear 139*b* rotates about the axis of the sungear 139*a* by being guided by the sun gear 139*a* and the connection member 139*c*. Namely, in this embodiment, the sun gear 139*a* and the connection member 139*c* correspond to a "guide part" of the present teaching.

When the ASF motor 102 rotates normally (clockwise) in a state where the selective drive gear 137 is connected to the ASF motor 102, power of the ASF motor 102 is transmitted to the gears 137, 139*a*, and 139*b*. This rotates the sun gear 139*a* in the counterclockwise direction in FIGS. 6A to 7B and rotates the planet gear 139*b* about the axis of the sun gear 139*a* in the clockwise direction in FIGS. 6A to 7B. This moves the planet gear 139*b* upward, so that the planet gear 139*b* engages with the crank gear 73 from below. The planet gear 139 engaging with the crank gear 73 is positioned below the crank gear 73.

Figure 6A:
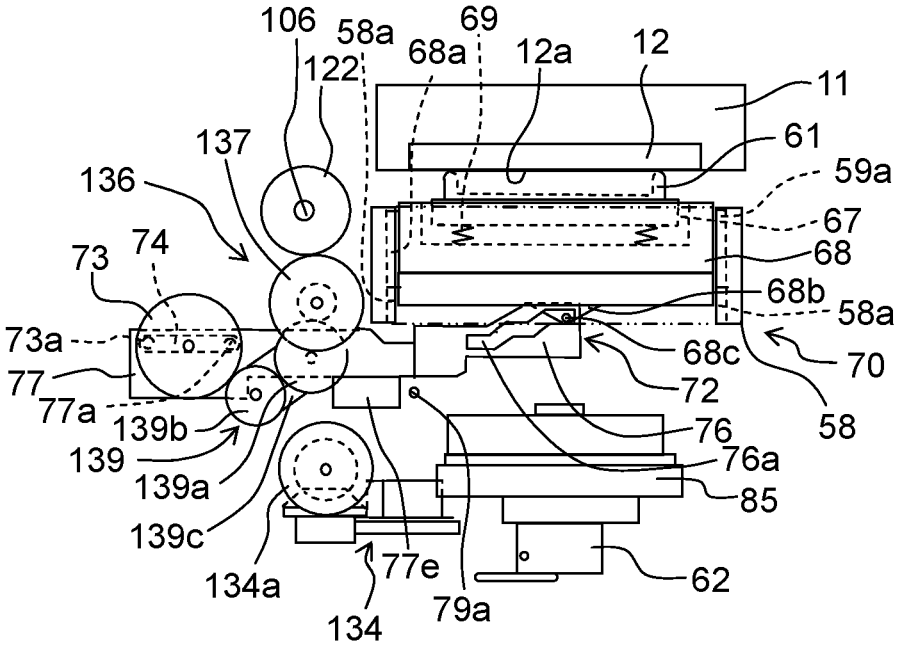
FIG. 6A is a diagram corresponding to FIG. 3A and depicting a state in which a nozzle cap is in a capping position.

When the normal rotation of the ASF motor 102 is continued further in the state where the planet gear 139 is engaged with the crank gear 73, power of the ASF motor 102 is transmitted to the crank gear 73 to rotate the crank gear 73 in the counterclockwise direction in FIG. 6A. Interlocked with the rotation of the crank gear 73, the slide cam 72 reciprocates in the conveyance direction.

When the slide cam 72 moves upstream in the conveyance direction, the protruding part 68*c* of the support member 68 slides on the parallel part 76*b*, the inclined part 76*e*, the parallel part 76*d*, the inclined part 76*f*, and the parallel part 76*c*, of a sliding surface 76*a*1 of the groove 76*a*, in that order. This lowers the cap holding part 71 and the nozzle cap 61. When the slide cam 72 moves downstream in the conveyance direction, the protruding part 68*c* of the support member 68 slides on the parallel part 76*c*, the inclined part 76*f*, the parallel part 76*d*, the inclined part 76*e*, and the parallel part 76*b*, of the sliding surface 76*a*1 of the groove 76*a*, in that order. This raises the cap holding part 71 and the nozzle cap 61. In that case, the oil damper 78 rotates while being interlocked with the movement of the slide cam 72. Accordingly, the cap lifting device 70 converts the rotation of the crank gear 73 in one direction into the reciprocating movement of the slide cam 72 in the conveyance direction to make the protruding part 68*c* of the support member 68 slide on the sliding surface 76*a*1 of the groove 76*a* of the slide cam 72, thereby moving the cap holding part 71 and the nozzle cap 61 up and down.

Figure 6B:
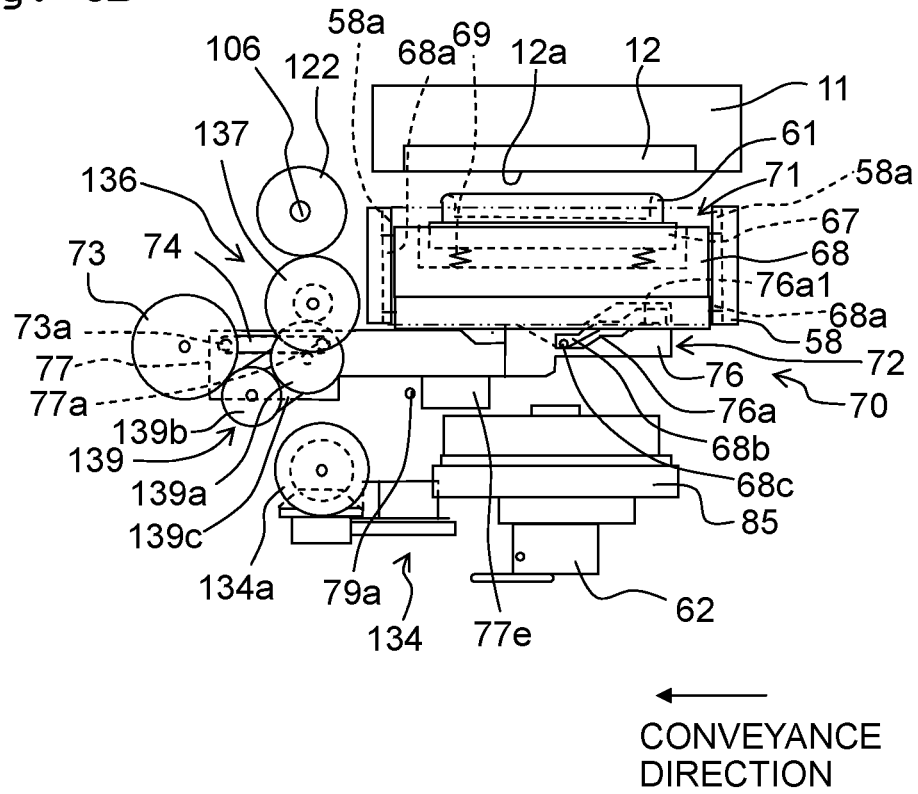
FIG. 6B is a diagram corresponding to FIG. 3A and depicting a state in which the nozzle cap is in an uncapping position.
Figure 7A:
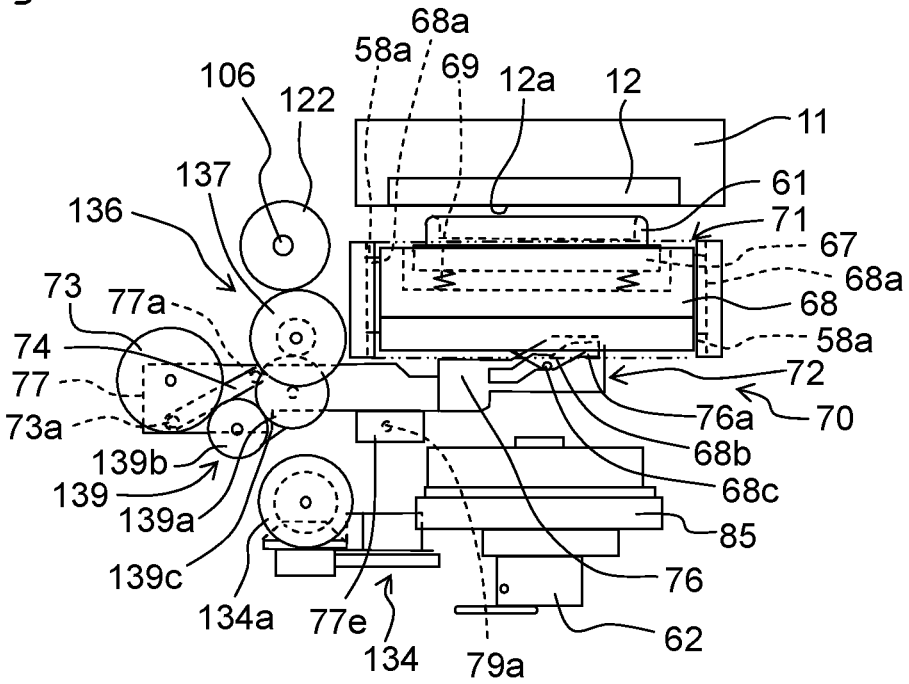
FIG. 7A is a diagram corresponding to FIG. 3A and depicting a state in which the nozzle cap is lowered to an intermediate position.
Figure 7B:
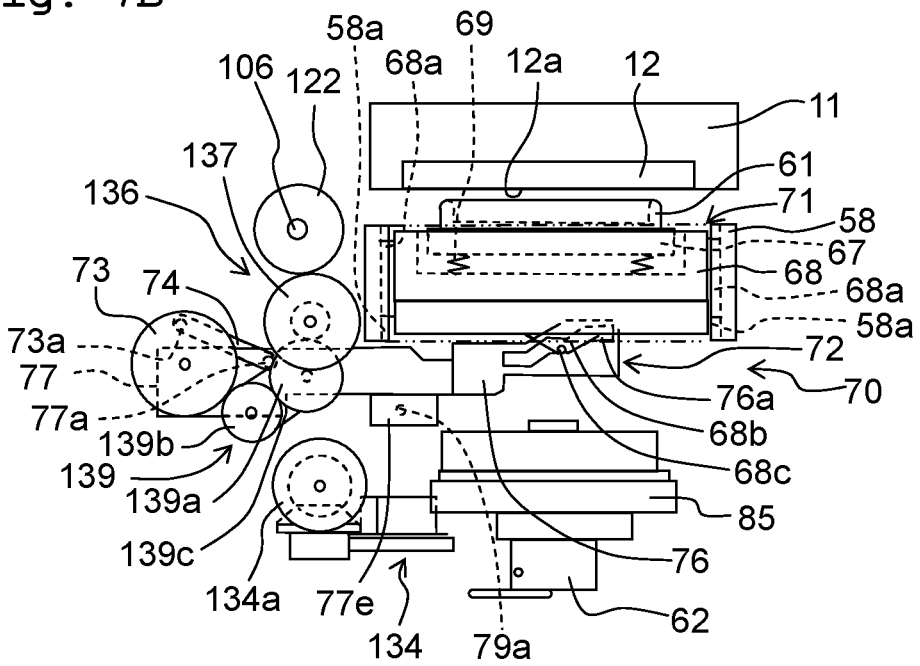
FIG. 7B is a diagram corresponding to FIG. 3A and depicting a state in which the nozzle cap is raised to the intermediate position.

As depicted in FIG. 6A, when the protruding part 68*c* is in the parallel part 76*b*, the nozzle cap 61 makes contact with the ink jetting surface 12*a* to cover nozzles 17 (in the following, this position of the nozzle cap 61 is to be referred to as a "capping position"). As depicted in FIG. 6B, when the protruding part 68*c* is in the parallel part 76*c*, the nozzle cap 61 is separated from the ink jetting surface 12*a* (in the following, this position of the nozzle cap 61 is to be referred to as an "uncapping position"). As depicted in FIGS. 7A and 7B, when the protruding part 68*c* is in the parallel part 76*d*, although the nozzle cap 61 is separated from the ink jetting surface 12*a*, the distance between the nozzle cap 61 and the ink jetting surface 12*a* is shorter than that of the case in which the protruding part 68*c* is in the parallel part 76*c* (in the following, this position of the nozzle cap 61 is to be referred to as an "intermediate position").

Figure 8A:
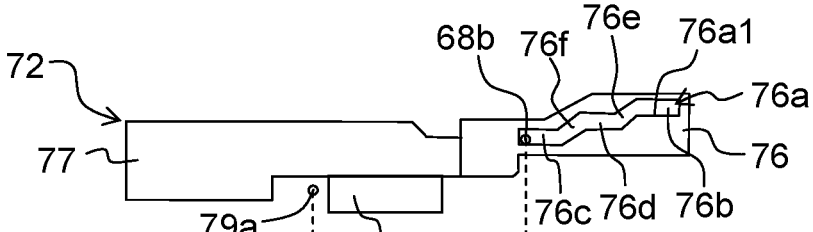
FIGS. 8A to 8G are diagrams depicting changes of a position of the slide cam and a detection state of a sensor.
Figure 8B:
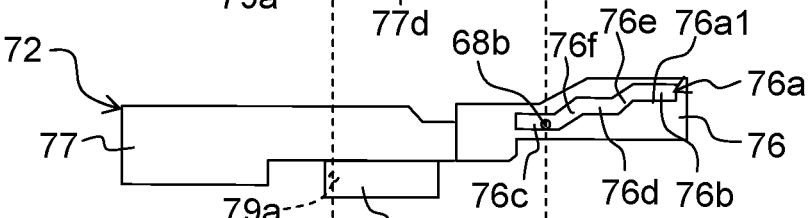
Figure 8C:
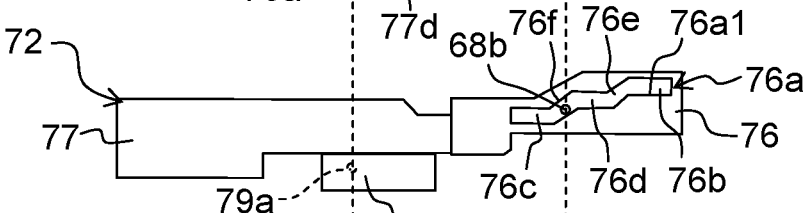
Figure 8D:
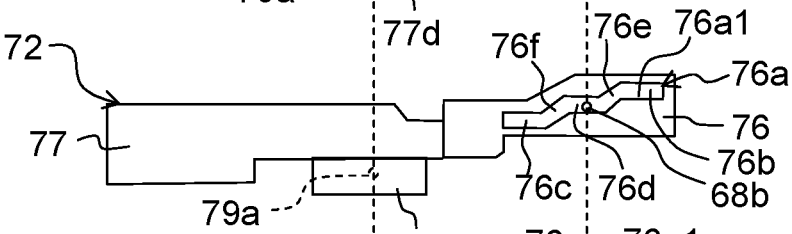
Figure 8E:
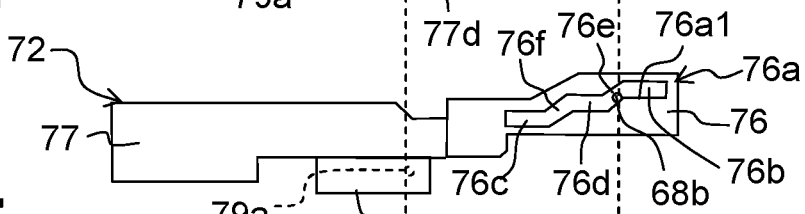
Figure 8F:
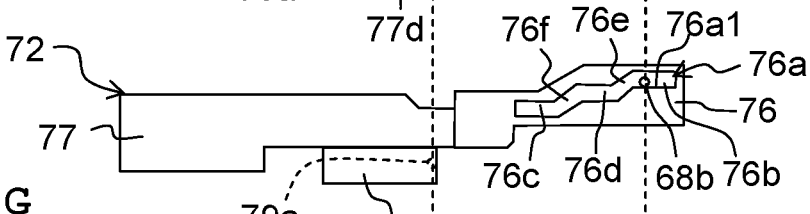
Figure 8G:
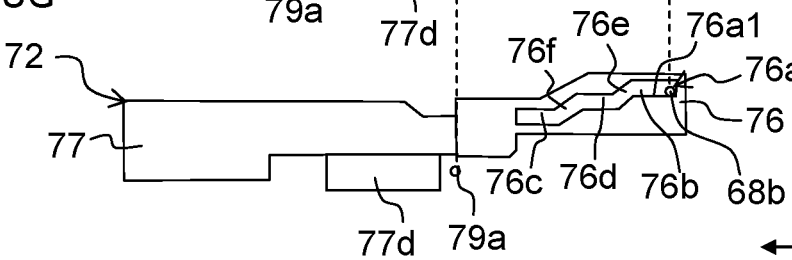
Figure 9:
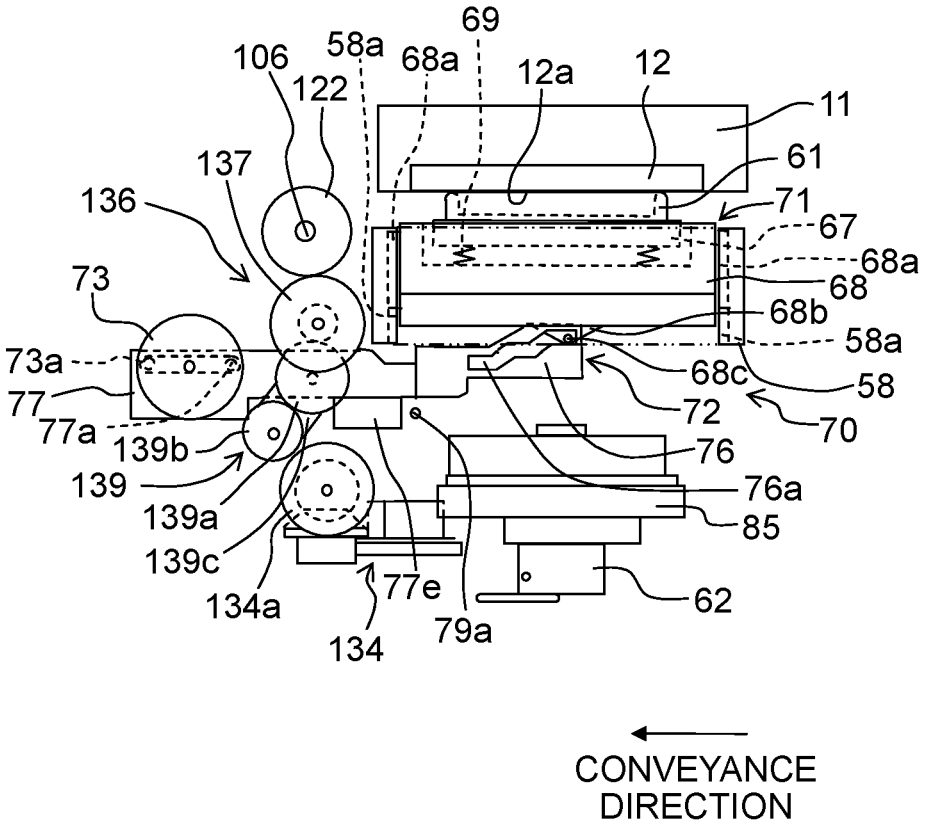
FIG. 9 is a diagram corresponding to FIG. 3A and depicting a state in which the switch valve is being driven.

Here, an explanation will be made about control of the ASF motor 102 for moving the nozzle cap 61 between the capping position and the uncapping position and the intermediate position. In this embodiment, the light blocking part 77*e* does not face the light emitting element 79*a* and the light emitting element 79*b* when the protruding part 68*c* is positioned downstream (on the side opposite to the inclined part 76*f*) of a predetermined point of the parallel part 76*c* (a point at which the protruding part 68*c* in FIG. 8B is positioned) in the conveyance direction as depicted in FIG. 8A and when the protruding part 68*c* is positioned upstream of a predetermined point of the parallel part 76*b* (a point at which the protruding part 68*c* in FIG. 8F is positioned) in the conveyance direction as depicted in FIG. 8G. As depicted in FIGS. 8B to 8F, the light blocking part 77*e* faces the light emitting element 79*a* and the light receiving element 79*b* when the protruding part 68*c* is positioned upstream (on the side of the inclined part 760 of the predetermined point of the parallel part 76*c* in the conveyance direction and downstream (on the side of the inclined part 76*e*) of the predetermined point of the parallel part 76*b* in the conveyance direction. For easy understanding, the length of the slide cam 72 in the conveyance direction depicted in FIGS. 8A to 8G is longer than that depicted in FIG. 3A.

On the basis of the above, in this embodiment, the ASF motor 102 is rotated normally in a state where the nozzle cap 61 is in the capping position as depicted in FIG. 6A, thereby moving the slide cam 72 in the conveyance direction. When the sensor 79 switches from the off state to the on state due to the movement of the slide cam 72, the ASF motor 102 is rotated further by a predetermined amount to move the nozzle cap 61 from the capping position to the intermediate position as depicted in FIG. 7A. In this situation, since the parallel part 76*d* extends parallel to the conveyance direction, even if the rotation amount of the ASF motor 102 after the sensor 79 switches from the off state to the on state varies slightly, the protruding part 68*c* is positioned in the parallel part 76*d* and the nozzle cap 61 is in the intermediate position reliably. Thus, even if the rotation amount of the ASF motor 102 after the sensor 79 switches from the off state to the on state varies slightly, the distance between the nozzle cap 61 and the ink jetting surface 12*a* does not vary.

In this embodiment, the ASF motor 102 is rotated further normally in the state where the nozzle cap 61 is in the intermediate position. When the sensor 79 switches from the on state to the off state, the ASF motor 102 is rotated still further by a predetermined amount to move the nozzle cap 61 from the intermediate position to the uncapping position as depicted in FIG. 6B. Since the parallel part 76*c* extends parallel to the conveyance direction, even if the rotation amount of the ASF motor 102 after the sensor 79 switches from the on state to the off state varies slightly, the protruding part 68*c* is positioned in the parallel part 76*c* and the nozzle cap 61 is in the uncapping position reliably.

In this embodiment, the ASF motor 102 is rotated further normally to move the slide cam 72 downstream in the conveyance direction in the state where the nozzle cap 61 is in the uncapping position. When the sensor 79 switches from the off state to the on state, the ASF motor 102 is rotated still further by a predetermined amount to move the nozzle cap 61 from the uncapping position to the intermediate position as depicted in FIG. 7B. Since the parallel part 76*d* extends parallel to the conveyance direction, even if the rotation amount of the ASF motor 102 after the sensor 79 switches from the off state to the on state varies slightly, the protruding part 68*c* is positioned in the parallel part 76*d* and the nozzle cap 61 is in the intermediate position reliably. Namely, even if the rotation amount of the ASF motor 102 after the sensor 79 switches from the off state to the on state varies slightly, the distance between the nozzle cap 61 and the ink jetting surface 12*a* does not vary.

In this embodiment, the ASF motor 102 is rotated further normally in the state where the nozzle cap 61 is in the intermediate position. When the sensor 79 switches from the on state to the off state, the ASF motor 102 is rotated still further by a predetermined amount to move the nozzle cap 61 from the intermediate position to the capping position as depicted in FIG. 6A. Since the parallel part 76*b* extends parallel to the conveyance direction, even if the rotation amount of the ASF motor 102 after the sensor 79 switches from the on state to the off state varies slightly, the protruding part 68*c* is positioned in the parallel part 76*b* and the nozzle cap 61 is in the capping position reliably.

When the ASF motor 102 is rotated counterclockwise in the state where the selective drive gear 137 is connected to the ASF motor 102, power of the ASF motor 102 is transmitted to the gears 137, 139*a*, and 139*b*. This rotates the sun gear 139*a* in the clockwise direction in FIG. 9 and rotates the planet gear 139*b* about the axis of the sun gear 139*a* in the counterclockwise direction in FIG. 9, thereby engaging the planet gear 139*b* with the valve drive gear 134*a* from above. When the ASF motor 102 is further rotated counterclockwise in the state where the planet gear 139*b* is engaged with the valve drive gear 134*a*, power of the ASF motor 102 is transmitted to the valve drive gear 134*a* to rotate respective gears constituting the valve drive gear group 134. This results in rotations of the valve cam 85 and the channel member 82. The rotation of the channel member 82 switches communication relations between the communicating ports 84*a* to 84*d* of the switch valve 62, such as the communication and non-communication between the cap communicating ports 84*a*, 84*b* and the pump communicating ports 84*d*.

<Material of Gear>

An explanation will be made about materials of the planet gear 139*b*, the crank gear 73, and the valve drive gear 134*a*, the crank gear 73 and the valve drive gear 134 engageable with the planet gear 139*b*. In this embodiment, as shown in FIG. 10, the crank gear 73 is made of a synthetic resin material, such as polyacetal resin (POM), containing, for example, glass fiber. The crank gear 73 contains, for example, approximately 25% by weight of glass fiber. Meanwhile, the planet gear 139*b* and the valve drive gear 134*a* are made of a synthetic resin material, such as polyacetal resin, containing no glass fiber. FIG. 10 shows whether or not respective gears contain glass fiber. In the printer 1, any other gears than the planet gear 139*b*, the crank gear 73, and the valve drive gear 134*a* are made, for example, of the synthetic resin material containing no glass fiber similar to the planet gear 139*b* and the valve drive gear 134*a*.

The crank gear 73 made of the synthetic resin material containing glass fiber has a coefficient of dynamic friction greater than those of the planet gear 139*b* and the valve drive gear 134*a* made of the synthetic resin material containing no glass fiber. For example, the coefficient of dynamic friction, of polyacetal resin containing no glass fiber, against the same material is approximately 0.3. Meanwhile, the coefficient of dynamic friction, of polyacetal resin containing 25% by weight of glass fiber, against the same material is approximately 0.5. Further, for example, DURACON (trade name) M90-44 produced by Polyplastics Co., Ltd., which is a POM resin containing no glass fiber, has a coefficient of dynamic friction against carbon steel of approximately 0.46; DURACON (trade name) GH20 produced by Polyplastics Co., Ltd., which is a POM resin containing 20% by mass of glass fiber, has a coefficient of dynamic friction against carbon steel of approximately 0.55; and DURACON (trade name) GH25 produced by Polyplastics Co., Ltd., which is a POM resin containing 25% by mass of glass fiber, has a coefficient of dynamic friction against carbon steel of approximately 0.60.

Thus, a maximum friction force between the planet gear 139*b* and the crank gear 73 obtained when the planet gear 139 is engaged with the crank gear 73 is greater than a maximum friction force between the planet gear 139*b* and the valve drive gear 134*a* obtained when the planet gear 139*b* is engaged with the valve drive gear 134*a*.

Figure 11:
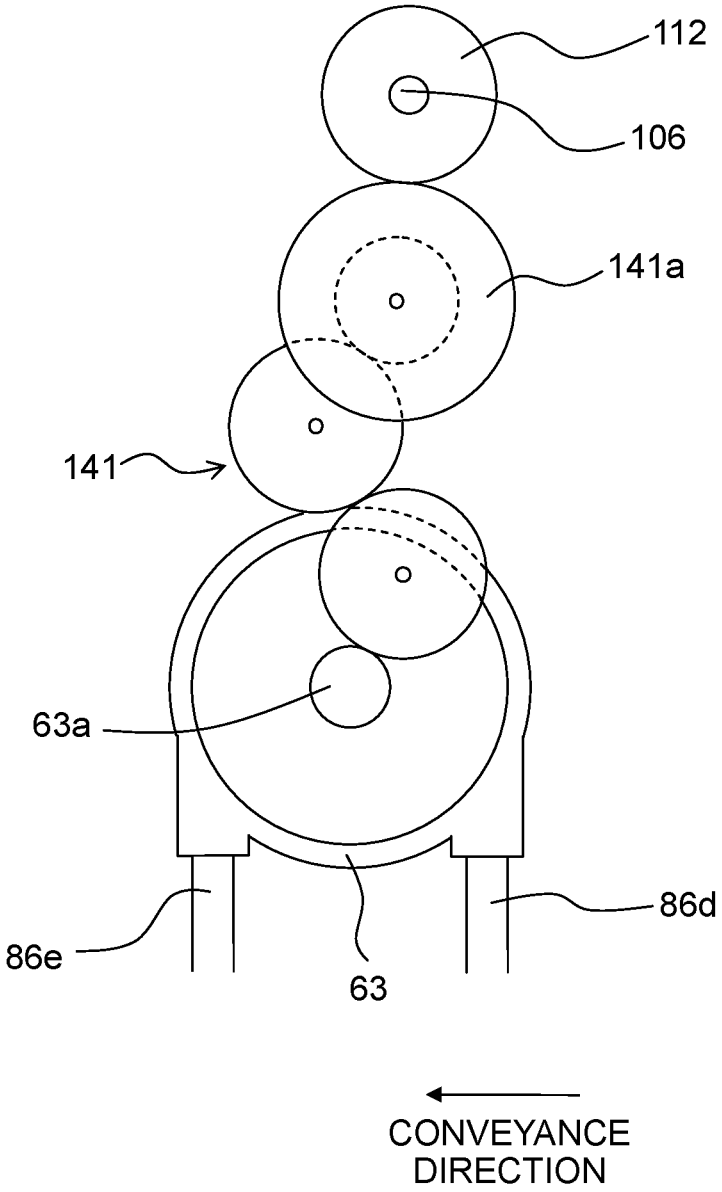
FIG. 11 depicts an arrangement of a suction pump and gears to be connected to the suction pump as viewed from the right in the scanning direction.

The suction pump 63 is a tube pump. As described above, the suction pump 63 communicates with the pump communicating port 84*d* of the switch valve 62 via the tube 86*d* and communicates with the waste liquid tank 64 via the tube 86*e* on the side opposite to the switch valve 62. As depicted in FIG. 11, the suction pump 63 includes a gear 63*a*. The gear 63*a*, which is connected to a pump drive gear group 141 including a pump drive gear 141*a*, is connectable to the PF motor 101 via the pump drive gear group 141 as will be described later. When the PF motor 101 is rotated normally in a state where the suction pump 63 is connected to the PF motor 101, power of the PF motor 101 is transmitted to the suction pump 63 to make the suction pump 63 the non-communication state in which the tube 86*d* does not communicate with the tube 86*e*. When the PF motor 101 is rotated further normally, the suction pump 63 performs suction. When the PF motor 101 is rotated reversely, power of the PF motor 101 is transmitted to the suction pump 63 to make the suction pump 63 the communication state in which the tube 86*d* communicates with the tube 86*e*. Since the tube pump that switches between the non-communication state and the communicating state according to the rotation direction is well known, more detailed explanation thereof is omitted here.

The waste liquid tank 64 receives, for example, the ink discharged through a suction purge, etc., as described later. The space of the waste liquid tank 64 for receiving the ink communicates with the atmosphere. Thus, the atmosphere communicating port 84*c*, which communicates with the waste liquid tank 64 via the tube 86*c*, communicates with the atmosphere. Further, when the suction pump 63 is in the communication state, the pump communicating port 84*d* communicates with the atmosphere via the tubes 86*d*, 86*e*, the suction pump 63, and the waste liquid tank 64.

<Switching of Motor Connection>

Subsequently, an explanation will be made about the switching of connection of each of the PF motor 101 and the ASF motor 102 with reference to FIGS. 12A to 12C and FIGS. 13A to 13C.

As depicted in FIGS. 12A to 12C and FIGS. 13A to 13C, the PF motor 101 is connected to a drive shaft 105. The drive roller 13*a* is mounted on the drive shaft 105. Further, a PF input gear 111 is mounted on the drive shaft 105. Driving the PF motor 101 rotates the drive shaft 105, the drive roller 13*a*, and the PF input gear 111 integrally.

The PF input gear 111 is engaged with a PF switch gear 112. The PF switch gear 112 is rotatably supported by a shaft 106 extending in the scanning direction. The PF switch gear 112 is movable, while being interlocked with movement of the carriage 11 in the scanning direction, along the shaft 106 in the scanning direction. Thus, the PF switch gear 112 can selectively move to any of the positions depicted in FIGS. 12A to 12C. The PF switch gear 112 does not engage with the pump drive gear 141*a* in the positions depicted in FIGS. 12A and 12B, and the PF switch gear 112 is engaged with the pump drive gear 141*a* in the position depicted in FIG. 12C. The PF input gear 111 extends in the scanning direction, and the PF switch gear 112 is engaged with the PF input gear 111 in all of the positions depicted in FIGS. 12A to 12C.

As depicted in FIGS. 12A to 12C and FIGS. 13A to 13C, the ASF motor 102 is connected to an ASF input gear group 120. The ASF input gear group 120 includes a clutch gear 121. As depicted in FIGS. 13A to 13C, FIG. 14A, and FIG. 14B, the clutch gear 121 includes two gears 121*a* and 121*b*. The gear 121*a* (a "first gear" of the present teaching) is a gear of which axis direction is parallel to the scanning direction. The gear 121*a* is connected to the ASF motor 102 via any other gear constituting the ASF input gear group 120. The gear 121*b* (a "second gear" of the present teaching), which is disposed coaxially with the gear 121*a*, is engaged with the ASF switch gear 122 while extending in the scanning direction.

Figure 14A:
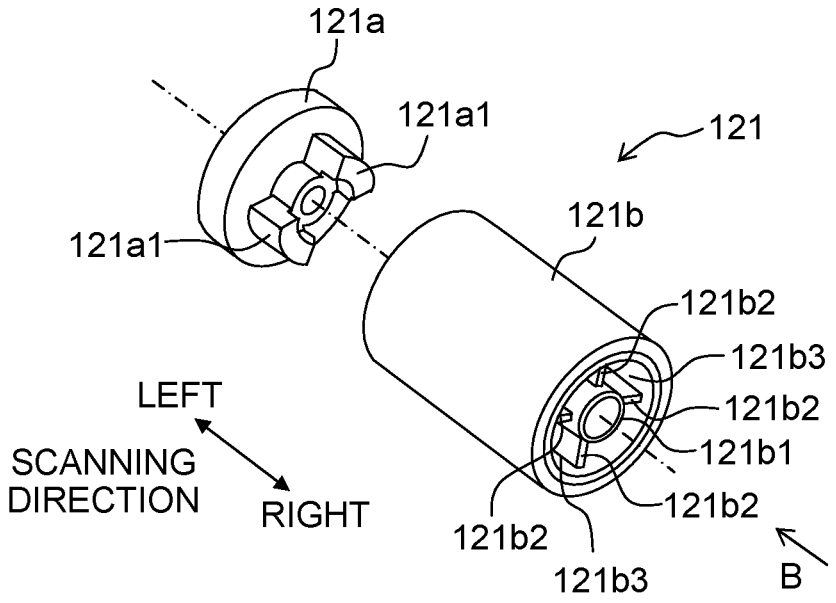
FIG. 14A is an exploded perspective view of a clutch gear depicted in FIGS. 13A to 13C.
Figure 14B:
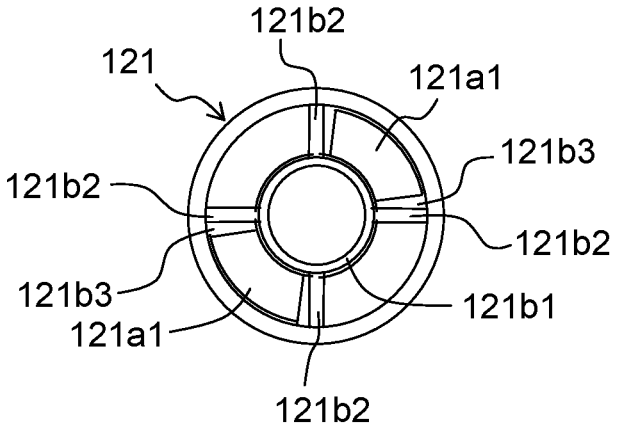
FIG. 14B depicts the clutch gear depicted in FIG. 14A as viewed in a direction of an arrow B.

The gear 121*a* is connected to the gear 121*b* with play in its rotation direction. More specifically, as depicted in FIGS. 14A and 14B, a side surface of the gear 121*a* is provided with two protruding parts 121*a*1. The two protruding parts 121*a*1 are disposed to be deviated in its circumferential direction of the gear 121*a* by approximately 180°. Each of the protruding parts 121*a*1 extends in the circumferential direction of the gear 121*a* while having an angle smaller than 90°. The interior of the gear 121*b* is provided with a cylindrical rib 121*b*1 extending in the scanning direction and four ribs 121*b*2 extending outward from an outer circumferential surface of the rib 121*b*1 in a radial direction of the gear 121*b*. Of the four ribs 121*b*2, the ribs 121*b*2 adjacent to each other in the circumferential direction of the gear 121*b* are disposed to be deviated from each other in the circumferential direction of the gear 121*b* by approximately 90°. The gear 121*a* is connected to the gear 121*b* by inserting each of the protruding parts 121*a*1 of the gear 121*a* into a space 121*b*3 between the two ribs 121*b*2 disposed adjacent to each other in the circumferential direction of the gear 121*b*. The rotation of the ASF motor 102 rotates the gear 121*a*. The gear 121*a* rotates independently before downstream ends of the protruding parts 121*a*1 in the rotation direction of the gear 121*a* make contact with the ribs 121*b*2, and the gear 121*a* and the gear 121*b* rotate integrally in a state where the downstream ends of the protruding parts 121*a*1 are in contact with the ribs 121*b*2.

The ASF switch gear 122 is mounted on the shaft 106 such that the positional relation between the ASF switch gear 122 and the PF switch gear 112 in the scanning direction is always kept. Thus, when the PF switch gear 112 moves in the scanning direction while being interlocked with movement of the carriage 11 in the scanning direction, the ASF switch gear 122 also moves in the scanning direction.

Figure 13A:
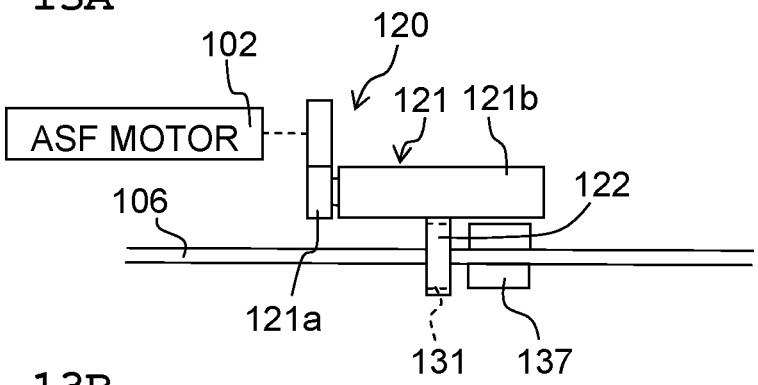
FIGS. 13A to 13C are diagrams each illustrating a connection relation between an ASF motor and an ASF input gear and the ASF switch gear as well as the switching of connection by the ASF switch gear, FIG. 13A depicting a state corresponding to FIG. 12A, FIG. 13B depicting a state corresponding to FIG. 12B, FIG. 13C depicting a state corresponding to FIG. 12C.
Figure 13B:
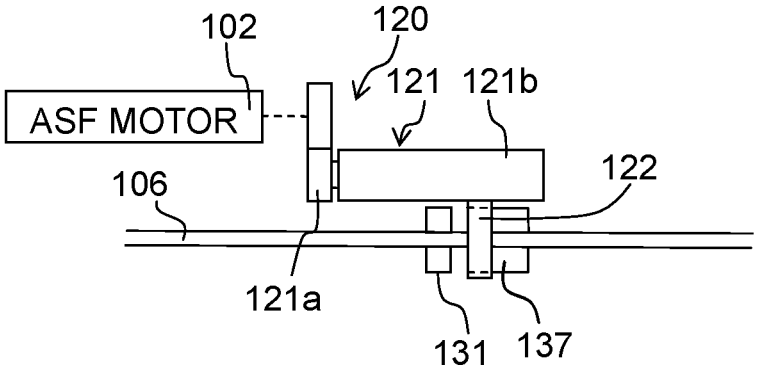
Figure 13C:
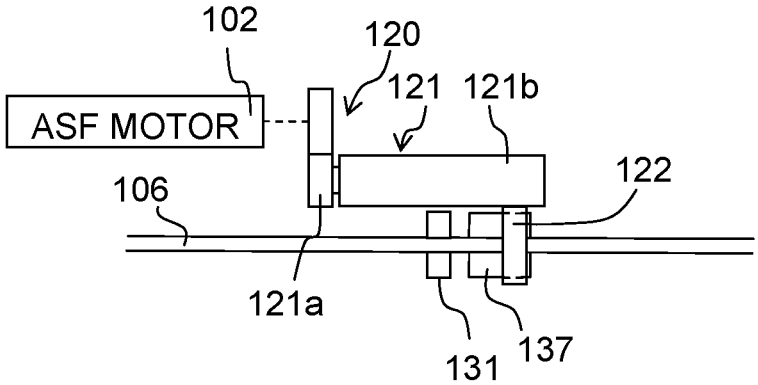

In this embodiment, the ASF switch gear 122 can be selectively moved to any of the positions depicted in FIGS. 13A to 13C during its movement in the scanning direction. The ASF switch gear 122 in the position depicted in FIG. 13A is engaged with the feed gear 131. The ASF switch gear 122 in the position depicted in FIGS. 13B and 13C is engaged with the selective drive gear 137. Since the gear 121*b* extends in the scanning direction, the ASF switch gear 122 in any of the positions depicted in FIGS. 13A to 13C is engaged with the gear 121*b*.

Before the ASF switch gear 122 is moved between the positions depicted in FIGS. 13A to 13C to switch the gear to be engaged with the ASF switch gear 122, the ASF motor 102 is driven to alternately rotate the ASF switch gear 122 and the gear to be engaged with the ASF switch gear 122 in both directions by a very small angle. This helps release of the gear engagement. In this embodiment, the clutch gear 121 is disposed between the ASF motor 102 and the ASF switch gear 122, and the gear 121*a* of the clutch gear 121 is relatively rotatable to the gear 121*b* of the clutch gear 21 within the play. This allows the ASF switch gear 122 and the gear to be engaged with the ASF switch gear 122 to rotate smoothly. Accordingly, the number of times the operation for disengagement is performed is reduced, thereby making it possible to reduce the time required for the switching of the gear to be engaged with the ASF switch gear 122.

<Controller>

Figure 15:
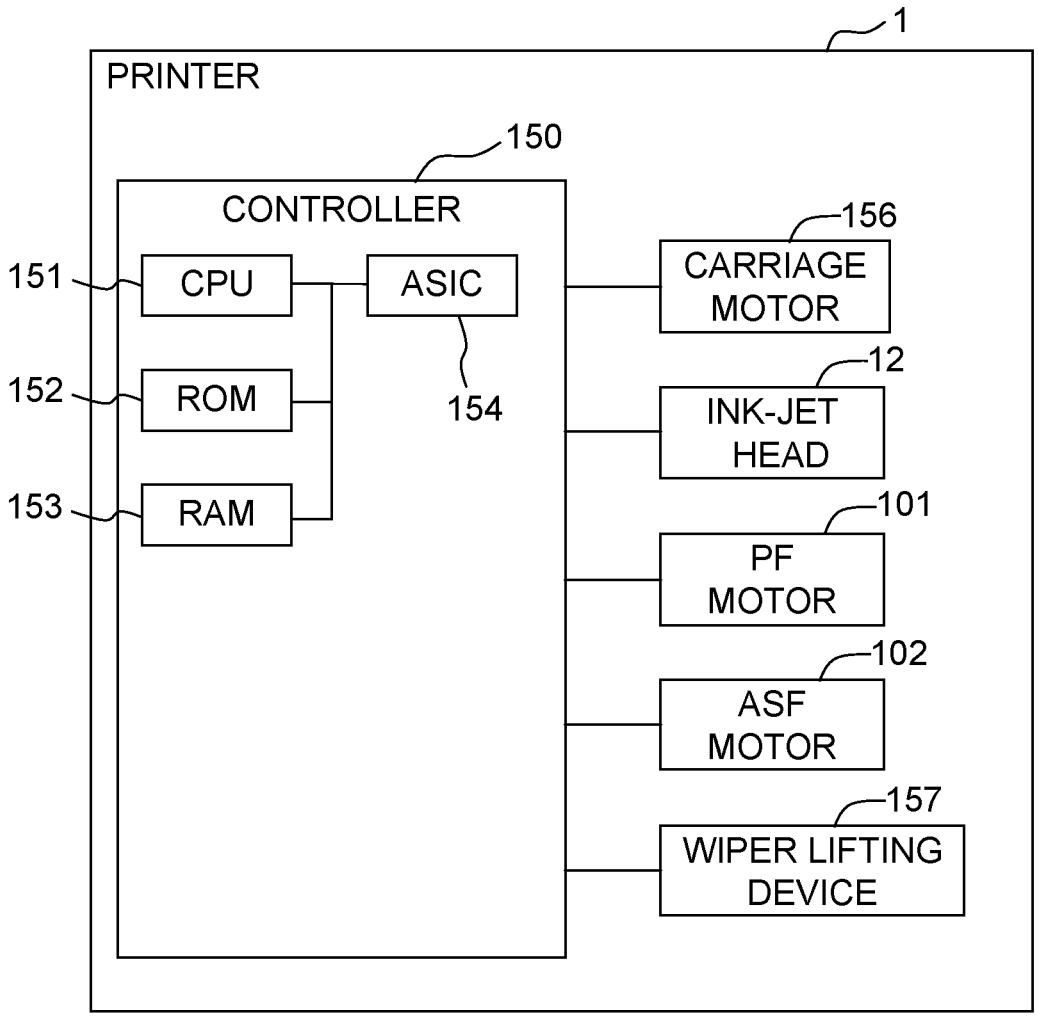
FIG. 15 is a block diagram depicting an electrical configuration of the printer.

Subsequently, an explanation will be made about a controller 150 that controls operation of the printer 1. As depicted in FIG. 15, the controller 150 includes a Central Processing unit (CPU) 151, a Read Only Memory (ROM) 152, a Random Access Memory (RAM) 153, an Application Specific Integrated Circuit (ASIC) 154, and the like. They work cooperatively to control the operation of the carriage motor 156, the ink-jet head 12, the PF motor 101, the ASF motor 102, the wiper lifting unit 157, and the like.

The controller 150 may include the single CPU 151, as depicted in FIG. 15, to make the CPU 151 perform processing collectively or include a plurality of CPUs 151 to make the CPUs 151 perform processing in a shared manner. The controller 150 may include the single ASIC 154, as depicted in FIG. 15, to make the ASIC 154 perform processing collectively or include a plurality of ASICs 154 to make the ASICs 154 perform processing in a shared manner.

<Printing Operation>

Figure 16A:
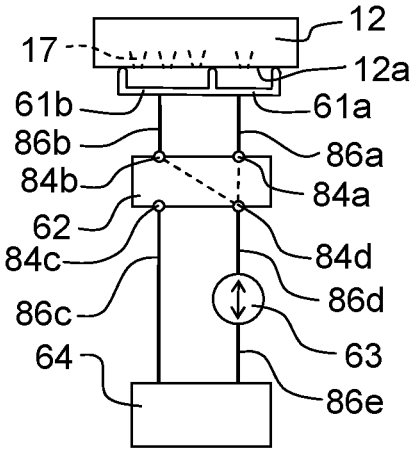
FIG. 16A to 16F are diagrams each depicting a communication relation between the nozzle cap and the switch valve and the suction pump, FIG. 16A depicting a standby state, FIG. 16B depicting a state in which valve cleaning is being performed, FIG. 16C depicting a state in which a suction purge for black ink is being performed, FIG. 16D depicting a state in which a suction purge for color inks is being performed, FIG. 16E depicting a state in which idle suction for black ink is being performed, FIG. 16F depicting a state in which idle suction for color inks is being performed.

Subsequently, an explanation will be made about a method of performing printing with the printer 1. When the printer 1 is in a standby state in which no printing and no maintenance which will be described later are performed, the nozzle cap 61 is in the capping position. This brings the nozzle cap 61 contact with the ink jetting surface 12*a* to prevent ink in nozzles 17 from being dried. In the standby state, the planet gear 139*b* is maintained in the engaging state with the crank gear 73. In the standby state, as depicted in FIG. 16A, the cap communicating ports 84*a* and 84*b* of the switch valve 62 communicate with the pomp communicating port 84*d* of the switch valve 62. In the standby state, the suction pump 63 is in the communicating state. Thus, the caps 61*a* and 61*b* of the nozzle cap 61 covering nozzles 17 communicate with the atmosphere via the suction pump 63 in the standby state. In the standby state, the PF switch gear 112 and the ASF switch gear 122 are in the positions depicted in FIG. 12C. In FIG. 16A, the two-headed arrow indicates the communicating state of the suction pump 63.

Figure 17:
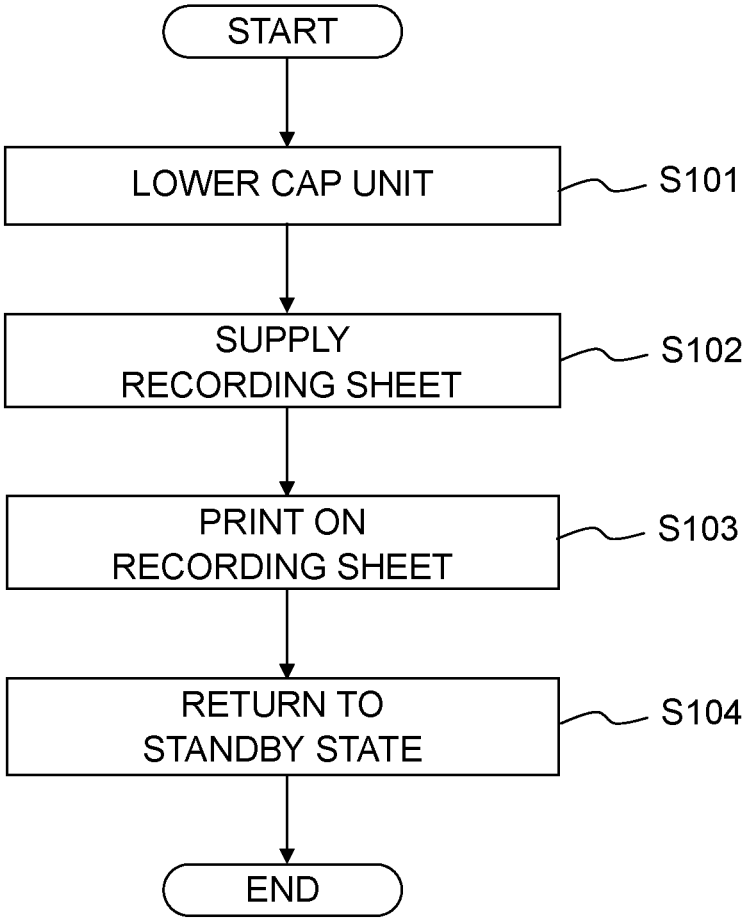
FIG. 17 is a flowchart of printing procedure performed by the printer.

To make the printer 1 perform printing, at first, the ASF motor 102 is rotated normally to lower the nozzle cap 61 from the capping position to the uncapping position (S101), as depicted in FIG. 17. Then, the carriage motor 156 is driven to move the carriage 11, thereby moving the PF switch gear 112 and ASF switch gear 122 to the position depicted in FIG. 12A. Then, the ASF motor 102 is rotated normally to supply the recording sheet P from the sheet cassette 21 to the printing unit 2 (S102).

Then, rotating the PF motor 101 normally makes the conveyance rollers 13 and 14 convey each supplied recording sheet P in the conveyance direction. The carriage motor 156 is driven to move the carriage 11 reciprocatively in the scanning direction and the ink-jet head 12 is driven to jet ink from nozzles 17, thereby performing printing on the recording sheet P (S103). After completion of printing, the printer 1 returns to the standby state (S104). In particular, the carriage motor 156 is driven to move the carriage 11 to a position where the ink jetting surface 12*a* faces the nozzle cap 61, and the ASF motor 102 is rotated normally in a state where the carriage 11 is in the above position to move the nozzle cap 61 from the uncapping position to the capping position. Further, the ASF motor 102 is rotated normally until the nozzle cap 61 reaches the capping position, and then the ASF motor 102 is stopped. This maintains engagement between the planet gear 139 and the crank gear 73.

When printing is performed, the gear to be engaged with the ASF switch gear 122 is switched before start of printing, as described above. Before the gear to be engaged with the ASF switch gear 122 is switched, the ASF motor 102 is driven to alternately rotate the ASF switch gear 122 and the gear to be engaged with the ASF switch gear 122 in both directions by a very small angle, thereby helping the release of the gear engagement. In this embodiment, since the clutch gear 121 is disposed between the ASF motor 102 and the ASF switch gear 122, the time required for switching of the gear to be engaged with the ASF switch gear 122 can be reduced. Accordingly, the time that elapses before the start of printing is shortened.

<Maintenance Process>

Figure 18:
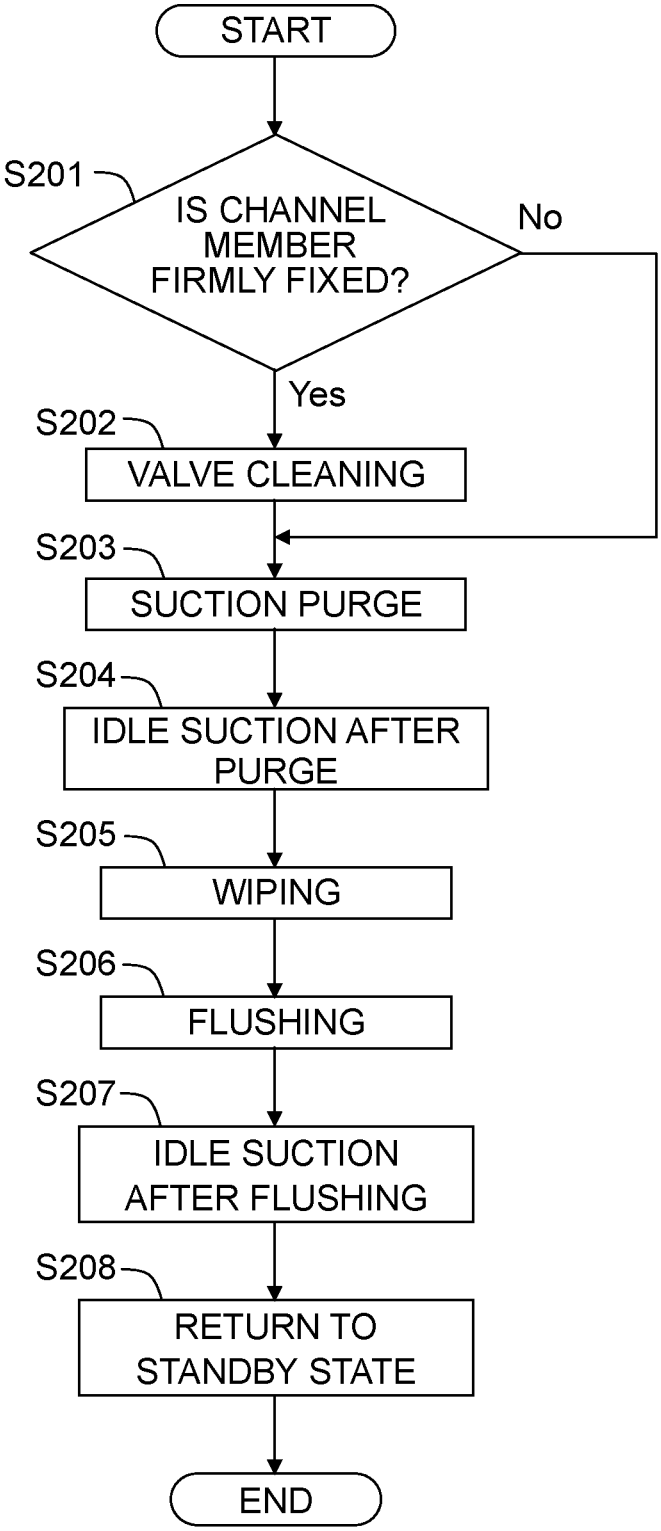
FIG. 18 is a flowchart of maintenance procedure.

Subsequently, an explanation will be made about a maintenance process using the maintenance unit 7 with reference to FIG. 18. In the maintenance process, the controller 150 first determines whether the channel member 82 is fixed so firmly to the accommodating member 81 that the channel member 82 can not rotate (S201). When the channel member 82 is not fixed firmly to the accommodating member 81 (S201: No), the controller 150 performs S203. When the channel member 82 is fixed firmly to the accommodating member 81 (S201: Yes), the controller 150 performs valve cleaning (S202) and then performs S203. In S201, for example, the determination is made as follows. Namely, when the ASF motor 102 is rotated reversely for a prescribed time period with the printer 1 being in the standby state, the channel member 82 may not rotate. In that case, a current flowing through the ASF motor 102 will exceed a predetermined threshold value, which makes it possible for the controller 150 to determine that the channel member 82 is fixed firmly to the accommodating member 81.

Figure 16B:
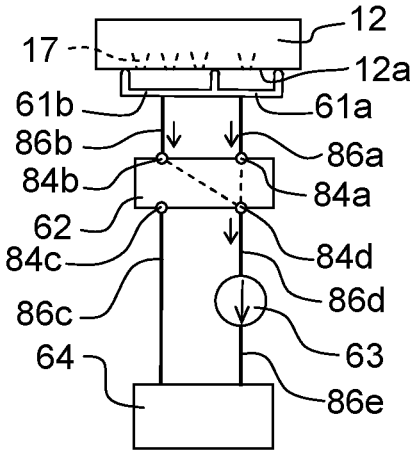

In valve cleaning, as depicted in FIG. 16B, rotating the PF motor 101 normally with the printer 1 being in the standby state allows the suction pump 63 to perform suction. The ink accumulating in the ink-jet head 12 is discharged from nozzles 17 through suction, flowing into the switch valve 62. The ink solidified in the switch valve 62 dissolves by absorbing moisture or water of ink flowing into the switch valve 62, thereby eliminating firm fixation of the channel member 82 to the accommodating member 81. Further, the ASF motor 102 is rotated reversely during suction with the suction pump 63 to rotate the channel member 82. This rotation allows the ink flowing into the switch valve 62 to spread over respective parts in the switch valve 62 uniformly, thereby making it possible to eliminate firm fixation of the channel member 82 to the accommodating member 81 efficiently. In FIG. 16B, down arrows indicate a state in which the suction pump 63 in the non-communication state performs suction. The same is true on FIGS. 16C to 16F.

When the suction purge or idle suction which will be described later is performed, ink flows into the switch valve 62. If the ink flowing into the switch valve 62 is left for a long time, it may solidify to cause the channel member 82 to be firmly fixed to the accommodating member 81. The firm fixation of the channel member 82 to the accommodating member 81 may fail to rotate the channel member 82 during the suction purge or the idle suction. In this embodiment, valve cleaning eliminates firm fixation of the channel member 82 to the accommodating member 81.

In S203, the controller 150 performs the suction purge. More specifically, in S203, the controller 150 successively performs the suction purge for black ink in which viscous black ink accumulating in the ink-jet head 12 is discharged and the suction purge for color inks in which viscous color inks accumulating in the ink-jet head 12 are discharged.

Figure 12C:
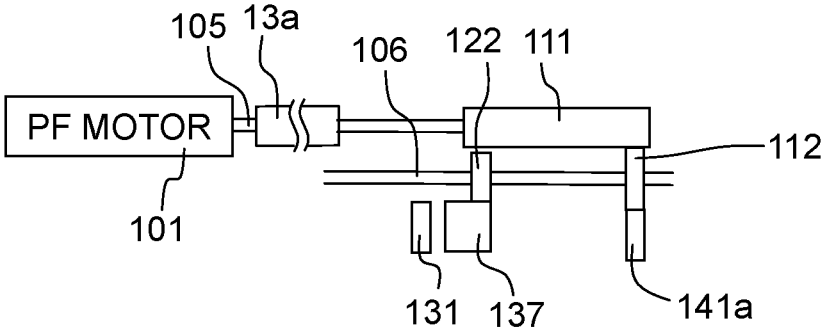
Figure 16C:
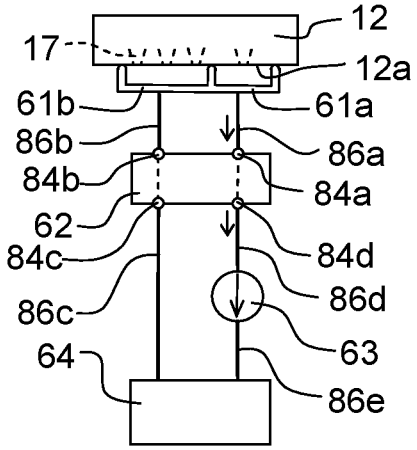

In the suction purge for black ink, the ASF motor 102 is rotated reversely to rotate the channel member 82 in a state where the nozzle cap 61 is in the capping position and the switch gears 112, 122 are in the positions depicted in FIG. 12C. The rotation of the channel member 82 allows the cap communicating port 84*a* to communicate with the pump communicating port 84*d* and allows the cap communicating port 84*b* to communicate with the atmosphere communicating port 84*c*, as depicted in FIG. 16C. In this situation, the PF motor 101 is rotated normally to make the suction pump 63 perform suction. Accordingly, the viscous black ink accumulating in the ink-jet head 12 is discharged from nozzles 17 forming the rightmost nozzle row 18. The reason why the cap communicating port 84*b* is allowed to communicate with the atmosphere communicating port 84*c* is that this prevents the increase in pressure in the cap 61*b* which would be otherwise caused when deformation of the nozzle cap 61 during suction reduces the volume of the space in the cap 61*b*.

Figure 16D:
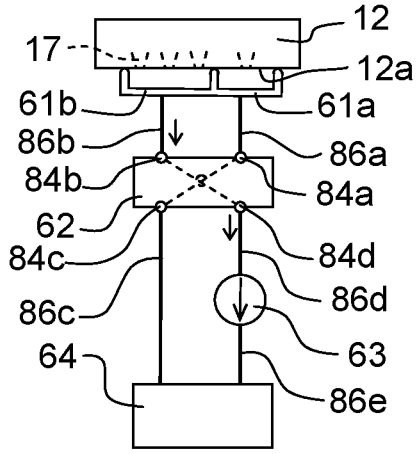

In the suction purge for color inks, the ASF motor 102 is rotated reversely to rotate the channel member 82 in the state where the nozzle cap 61 is in the capping position and the switch gears 112, 122 are in the positions depicted in FIG. 12C. The rotation of the channel member 82 allows the cap communicating port 84*b* to communicate with the pump communicating port 84*d* and allows the cap communicating port 84*a* to communicate with the atmosphere communicating port 84*c*, as depicted in FIG. 16D. In this situation, the PF motor 101 is rotated normally to make the suction pump 63 perform suction. Accordingly, the viscous color inks accumulating in the ink-jet head 12 are discharged from nozzles 17 forming the three nozzle rows 18 on the left of the rightmost nozzle row 18. The reason why the cap communicating port 84*a* is allowed to communicate with the atmosphere communicating port 84*c* is that this prevents the increase in pressure in the cap 61*a* which would be otherwise caused when deformation of the nozzle cap 61 during suction reduces the volume of the space in the cap 61*a*.

Subsequently, the controller 150 performs the idle suction in which the ink accumulating in the nozzle cap 61 is discharged through the suction purge (S204). More specifically, in S204, the controller 150 successively performs the idle suction for black ink in which the black ink accumulating in the cap 61*a* is discharged by the suction purge for black ink and the idle suction for color inks in which the color inks accumulating in the cap 61*b* are discharged by the suction purge for color inks.

Figure 16E:
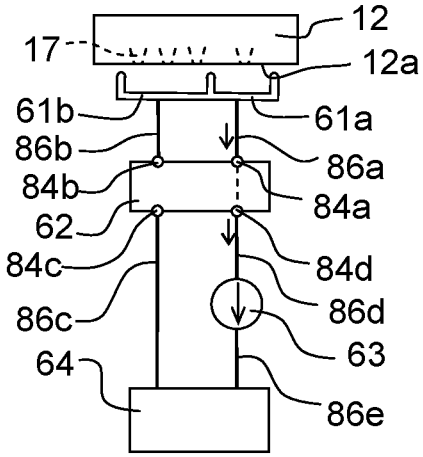

In the idle suction for black ink, the ASF motor 102 is rotated normally to rotate the crank gear 73 in a state where the switch gears 112, 122 are in the positions depicted in FIG. 12C. The rotation of the crank gear 73 lowers the nozzle cap 61 from the capping position to the intermediate position, as depicted in FIG. 7A. Subsequently, the ASF motor 102 is rotated reversely to rotate the channel member 82. The rotation of the channel member 82 allows the cap communicating port 84*a* to communicate with the pump communicating port 84*d*, as depicted in FIG. 16E. In this situation, the PF motor 101 is rotated normally to make the suction pump 63 perform suction. Accordingly, the black ink accumulating in the cap 61*a* is discharged.

Figure 16F:
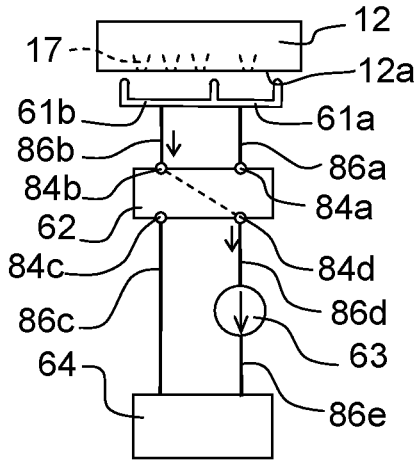

In the idle suction for color inks, the ASF motor 102 is rotated reversely to rotate the channel member 82 in a state where the nozzle cap 61 is in the intermediate position as depicted in FIG. 7A. The rotation of the channel member 82 allows the cap communicating port 84*b* to communicate with the pump communicating port 84*d*, as depicted in FIG. 16F. In this situation, the PF motor 101 is rotated normally to make the suction pump 63 perform suction. Accordingly, the color inks accumulating in the cap 61*b* are discharged.

In some cases, except this embodiment, the ink (bridge) between the nozzle cap 61 and the ink jetting surface 12*a* may be broken when the nozzle cap 61 is lowered from the capping position to the uncapping position in idle suction to separate the nozzle cap 61 from the ink jetting surface 12*a*. This might cause ink to be scattered around the nozzle cap 61. In this embodiment, the nozzle cap 61 is lowered to the intermediate position in idle suction, and the height of the intermediate position of the nozzle cap 61 is designed such that the ink bridge is not broken when the nozzle cap 61 is lowered to the intermediate position. Thus, in this embodiment, it is possible to prevent ink from being scattered around the nozzle cap 61 which would be otherwise caused by the destruction of ink bridge in idle suction.

Subsequently, the controller 150 performs wiping by which ink adhering to the ink jetting surface 12*a* is wiped with the wiper 59 (S205). To perform wiping, the ASF motor 102 is rotated normally to rotate the crank gear 73. The rotation of the crank gear 73 lowers the nozzle cap 61 to the uncapping position, as depicted in FIG. 6B. Further, the wiper lifting unit 157 is driven to move the wiper 59 upward, and the carriage motor 156 is driven to move the carriage 11 in the scanning direction. Accordingly, ink adhering to the ink jetting surface 12*a* is wiped with the wiper 59. If the nozzle cap 61 is in the intermediate position during wiping, the ink jetting surface 12*a* may make contact with the nozzle cap 61 during movement of the carriage 11 in the scanning direction, because the distance between the nozzle cap 61 and the ink jetting surface 12*a* in the state where the nozzle cap 61 is in the intermediate position is smaller than that of the case in which the nozzle cap 61 is in the uncapping position. In this embodiment, in order to prevent the ink jetting surface 12*a* from making contact with the nozzle cap 61, the nozzle cap 61 is lowered from the intermediate position to the uncapping position before the start of wiping.

Subsequently, the controller 150 performs flushing to discharge ink flowing from nozzles 17 through wiping (S206). To perform flushing, the carriage motor 156 is driven to return the carriage 11 to the position where the ink jetting surface 12*a* faces the nozzle cap 61. Then, the ASF motor 102 is rotated normally to rotate the crank gear 73. The rotation of the crank gear 73 raises the nozzle cap 61 up to the intermediate position, as depicted in FIG. 7B. In this situation, ink is discharged from nozzles 17 of the ink-jet head 12 to the nozzle cap 61.

In some cases, except for this embodiment, flushing may be performed in a state where the nozzle cap 61 is in the uncapping position. In that case, ink jetted from nozzles 17 through flushing might be spattered on the nozzle cap 61 to fly out of the nozzle cap 61. In this embodiment, during flushing, the nozzle cap 61 is in the intermediate position that is closer to the ink jetting surface 12*a* than the uncapping position. This prevents ink jetted from nozzles 17 through flushing from being spattered on the nozzle cap 61 to fly out of the nozzle cap 61.

Subsequently, the controller 150 performs idle suction similar to S204 to discharge ink accumulating in the nozzle cap 61 through flushing (S207). After completion of the idle suction in S207, the ASF motor 102 is rotated normally to move the nozzle cap 61 to the capping position as depicted in FIG. 6A, and the printer 1 returns to the standby state (S208). In this situation, engagement between the planet gear 139*b* and the crank gear 73 is maintained by stopping the ASF motor 102 after the ASF motor 102 is rotated normally until the nozzle cap 61 reaches the capping position. Then, maintenance is completed.

To shorten the time from the standby state to the start of printing as much as possible, the printer 1 is required to shorten, as much as possible, the time required for movement of the nozzle cap 61 from the capping position to the uncapping position. In this embodiment, the planet gear 139*b* is movable between the engagement position with the crank gear 73 and the engagement position with the valve drive gear 134*a*. Thus, if external force is applied on the planet gear 139*b* engaging with the crank gear 73, the planet gear 139*b* might disengage from the crank gear 73.

When the ASF motor 102 is driven to move the nozzle cap 61 from the capping position to the uncapping position in the state where the planet gear 139*b* is disengaged from the crank gear 73, rotation of the crank gear 73, namely, downward movement of the nozzle cap 61 is started at a point of time at which the planet gear 139 reaches the engagement position with the crank gear 73. In that case, the nozzle cap 61 does not move downward while the planet gear 139*b* is moving to the engagement position with the crank gear 73, thus lengthening the time required for movement of the nozzle cap 61 from the capping position to the uncapping position. This lengthens the time that elapses before the start of printing.

In this embodiment, since the planet gear 139*b* engages with the crank gear 73 from below, gravity might cause the planet gear 139 to disengage from the crank gear 73.

In this embodiment, the clutch gear 121 is disposed between the ASF motor 102 and the ASF switch gear 122. This reduces the time required for switching of the gear to be engaged with the ASF switch gear 122, thus reducing the time that elapses before the start of printing. On the other hand, when the clutch gear 121 is disposed between the ASF motor 102 and the ASF switch gear 122, relative rotation of the gears 121*a* and 121*b* of the clutch gear 121 within the play might cause the planet gear 139*b* to disengage from the crank gear 73. Disengagement of the planet gear 139 from the crank gear 73 lengthens the time that elapses before the start of printing.

Thus, the crank gear 73 in this embodiment is made of the synthetic resin material containing glass fiber. This makes the maximum friction force between the planet gear 139*b* and the crank gear 73 greater than that of the case in which both of the planet gear 139*b* and the crank gear 73 are made of the synthetic resin material containing no glass fiber, thereby making it harder for the planet gear 139 to disengage from the crank gear 73. As a result, the time required for movement of the nozzle cap 61 from the capping position to the uncapping position can be shortened.

Unlike this embodiment, not the crank gear 73 but the planet gear 139*b* may be made of the synthetic resin material containing glass fiber. In that case, the maximum friction force between the planet gear 139*b* and the valve drive gear 134*a* is greater than that of the case in which both of the planet gear 139*b* and the valve drive gear 134*a* are made of the synthetic resin material containing no glass fiber, thereby making it harder for the planet gear 139*b* to disengage from the valve drive gear 134*a*. When the planet gear 139*b* moves from the engagement position with the valve drive gear 134*a* to the engagement position with the crank gear 73, disengagement of the planet gear 139*b* from the valve drive gear 134*a* is helped by driving the ASF motor 102 to alternately rotate the planet gear 139*b* and the valve drive gear 134*a* in both directions by a very small angle. If it is difficult to release engagement between the planet gear 139*b* and the valve drive gear 134*a*, the number of times the operation for disengagement is performed increases, thus lengthening the time that elapses before movement of the planet gear 139*b* is started.

In this embodiment, the crank gear 73 is made of the synthetic resin material containing glass fiber, and the planet gear 139*b* and the valve drive gear 134*a* are made of the synthetic resin material containing no glass fiber. This eliminates the difficulty in releasing engagement between the planet gear 139*b* and the valve drive gear 134*a*.

In this embodiment, the ASF motor 102 is stopped after normal rotation of the ASF motor 102 moves the nozzle cap 61 to the capping position, thereby maintaining engagement between the planet gear 139*b* and the crank gear 73. This enables the nozzle cap 61 to move downward immediately after the ASF motor 102 is rotated normally to move the nozzle cap 61 from the capping position to the uncapping position, for example, for the next printing. Thus, the time required for moving the nozzle cap 61 from the capping position to the uncapping position is shortened.

Subsequently, an explanation will be made about modified examples in which various modifications are added to the above embodiment. The constitutive parts or components, which are the same as or equivalent to those of the embodiment described above, are designated by the same reference numerals, any explanation of which will be omitted as appropriate.

In the above embodiment, of the crank gear 73 and the planet gear 139*b* that are engageable with each other, only the crank gear 73 is made of the synthetic resin material containing glass fiber, and the planet gear 139*b* is made of the synthetic resin material containing no glass fiber. The present teaching, however, is not limited thereto.

In a first modified example, as indicated in FIG. 19A, the planet gear 139*b* is made of the synthetic resin material containing glass fiber, and the crank gear 73 and the valve drive gear 134*a* are made of the synthetic resin material containing no glass fiber. In that case, like the above embodiment, disengagement of the planet gear 139 from the crank gear 73 is harder than the case in which both of the crank gear 73 and the planet gear 139*b* are made of the synthetic resin material containing no glass fiber.

In a second modified example, as indicated in FIG. 19B, the crank gear 73 and the planet gear 139*b* are made of the synthetic resin material containing glass fiber, and the valve drive gear 134*a* is made of the synthetic rein material containing no glass fiber. In that case, disengagement of the planet gear 139*b* from the crank gear 73 is much harder than the cases, like the above embodiment and the first modified example, in which only one of the crank gear 73 and the planet gear 139*b* is made of the synthetic resin material containing the glass fiber.

In the above embodiment and the first and second modified examples, the valve drive gear 134*a* is made of the synthetic resin material containing no glass fiber. The present teaching, however, is not limited thereto.

In a third modified example, as indicated in FIG. 19C, the crank gear 73 and the valve drive gear 134*a* are made of the synthetic resin material containing glass fiber, and the planet gear 139*b* is made of the synthetic resin material containing no glass fiber.

In a fourth modified example, as indicated in FIG. 19D, the planet gear 139*b* and the valve drive gear 134*a* are made of the synthetic resin material containing glass fiber, and the crank gear 73 is made of the synthetic resin material containing no glass fiber.

In a fifth modified example, as indicated in FIG. 19E, all of the crank gear 73, the planet gear 139*b*, and the valve drive gear 134*a* are made of the synthetic resin material containing glass fiber.

Like the above embodiment and the first and second modified examples, the third to fifth modified examples make it harder for the planet gear 139*b* to disengage from the crank gear 73.

Note that, when at least one of the planet gear 139*b* and the valve drive gear 134*a* is made of the synthetic resin material containing glass fiber as in the first to the fifth modified examples, disengagement of the planet gear 139*b* from the valve drive gear 134*a* is harder than the above embodiment.

In the second to fifth modified examples, two or more of the crank gear 73, the valve drive gear 134*a*, and the planet gear 139*b* may be made of the synthetic resin material containing glass fiber. In that case, gears containing the glass fiber may have a content rate of glass fiber identical to each other or content rates of glass fiber different from each other.

Note that, when both of the crank gear 73 and the planet gear 139*b* are made of the synthetic resin material containing glass fiber as in the second and fifth modified examples, it is preferred that a content rate R1 of glass fiber in the crank gear 73 be higher than a content rate R2 of glass fiber in the planet gear 139*b*, as indicated in FIG. 20A.

Regarding the gear made of the synthetic resin material containing glass fiber, the coefficient of dynamic friction increases as the content rate of glass fiber is higher. For example, NOVALLOY (trade name) B2504 produced by Daicel Polymer Ltd., which is an ABS/PBT resin containing 20% by mass of glass fiber, has a coefficient of dynamic friction against the same material of approximately 0.32. NOVALLOY (trade name) B2509 produced by Daicel Polymer Ltd., which is an ABS/PBT resin containing 45% by mass of glass fiber, has a coefficient of dynamic friction against the same material of approximately 0.36. As described above, DURACON (trade name) GH20 produced by Polyplastics Co., Ltd., which is a POM resin containing 20% by mass of glass fiber, has a coefficient of dynamic friction against carbon steel of approximately 0.55. DURACON (trade name) GH25 produced by Polyplastics Co., Ltd., which is a POM resin containing 25% by mass of glass fiber, has a coefficient of dynamic friction against carbon steel of approximately 0.60.

Thus, when the content rate R1 of glass fiber in the crank gear 73 is higher than the content rate R2 of glass fiber in the planet gear 139*b*, engagement between the valve drive gear 134*a* and the crank gear 73 can be released as easily as possible in a state where engagement between the crank gear 73 and the planet gear 139*b* is not released easily.

When both of the crank gear 73 and the valve drive gear 134*a* are made of the synthetic resin material containing glass fiber as in the third and fifth modified examples, it is preferred that a content rate R3 of glass fiber in the crank gear 73 be higher than a content rate R4 of glass fiber in the valve drive gear 134*a*, as indicated in FIG. 20B.

As described above, regarding the gear made of the synthetic resin material containing glass fiber, the coefficient of dynamic friction increases as the content rate of glass fiber is higher. Thus, when the content rate R3 of glass fiber in the crank gear 73 is higher than the content rate R4 of glass fiber in the valve drive gear 134*a*, engagement between the valve drive gear 134*a* and the crank gear 73 can be released as easily as possible in state where engagement between the crank gear 73 and the planet gear 139*b* is not released easily.

In the embodiment and the first to fifth modified examples, engagement between the crank gear 73 and the planet gear 139*b* is not released easily by using the synthetic resin material containing glass fiber in at least one of the crank gear 73 and the planet gear 139*b*. The present teaching, however, is not limited thereto. For example, the maximum friction force between the crank gear 73 and the planet gear 139*b* obtained when the crank gear 73 is engaged with the planet gear 139*b* can be improved by performing a surface treatment for the crank gear 73 and the planet gear 139*b* so that concavities and convexities are formed on their gear surfaces. In that case, it is not indispensable that both of the crank gear 73 and the planet gear 139*b* are made of the synthetic resin material. For example, one of the crank gear 73 and the planet gear 139*b* may be made of the synthetic resin material, and the other of the crank gear 73 and the planet gear 139*b* may be made of metal.

In the above embodiment, the clutch gear 121 is provided between the ASF switch gear 122 and the ASF motor 102 to be engageable with the ASF switch gear 122. The present teaching, however, is not limited thereto. The clutch gear 121 may be provided between the ASF switch gear 122 and the ASF motor 102 to be engageable with the ASF switch gear 122 via another gear. Or, the clutch gear 121 may be a gear, of gears provided between the ASF motor 102 and the crank gear 73, disposed on the side closer to the crank gear 73 than the ASF switch gear 122, such as a gear provided between the ASF switch gear 122 and the sun gear 139*a*. Or, the clutch gear 121 may not be provided between the ASF motor 102 and the crank gear 73.

In the above embodiment, the planet gear 139*b* engages with the crank gear 73 from below. The present teaching, however, is not limited thereto. The planet gear 139*b* may engage with the crank gear 73 from a horizontal direction, or the planet gear 139*b* may engage with the crank gear 73 from above. In those cases, it is possible to prevent disengagement of the planet gear 139*b* from the crank gear 73 which would be otherwise caused when some reason causes external force in a direction in which the planet gear 139*b* separates from the crank gear 73 to act on the planet gear 139*b*.

In the above embodiment, the planet gear 139*b* is engageable with the crank gear 73 connected to the slide cam 72. The present teaching, however, is not limited thereto. The planet gear 139*b* may be connected to the crank gear 73 via another gear. In that case, the another gear corresponds to the "first transmission gear" of the present teaching.

In the above embodiment, the valve drive gear 134*a* engageable with the planet gear 139*b* is connected to the valve cam 85 via another gear constituting the valve drive gear group 134. The present teaching, however, is not limited thereto. The planet gear 139*b* may be engageable with a gear that is directly connected to the valve cam 85. In that case, the gear directly connected to the valve cam 85 corresponds to the "second transmission gear" of the present teaching.

In the above embodiment, the planet gear 139*b* is movable between the position where it engages with the crank gear 73 to move the nozzle cap 61 upward and the position where it engages with the valve drive gear 134*a* to rotate the valve cam 85. The present teaching, however, is not limited thereto. The planet gear 139*b* is movable between the position where it engages with the crank gear 73 and a position where it engages with a gear (the "second transmission gear" of the present teaching) for transmitting power to a driven device except for the valve cam 85.

In the above embodiment, the planet gear 139*b* is guided by the sun gear 139*a* and the connection member 139*c* to move between the engagement position with the crank gear 73 and the engagement position with the valve drive gear 134*a*. The present teaching, however, is not limited thereto. The planet gear 139*b* may be guided by a guide part configured to be different from that of the above embodiment.

In the above embodiment, rotating the planet gear 139*b* around the shaft of the sun gear 139*a* depending on the rotation direction of the sun gear 139*a* (the rotation direction of the ASF motor 102) enables movement of the planet gear 139*b* between the engagement position with the crank gear 73 and the engagement position with the valve drive gear 134*a*. The present teaching, however, is not limited thereto. It is allowable to provide a gear (a "movement gear" of the present teaching) that has a configuration different from that of the planet gear mechanism 139 and is movable between an engagement position with the crank gear 73 and an engagement position with the valve drive gear 134*a* by moving in different directions depending on the rotation direction of the ASF motor 102. In that case, the movement gear moving between the two positions is guided by a guide part configured to be different from the sun gear 139*a* and the connection member 139*c* of the above embodiment.

In the above embodiment, power from the ASF motor 102 drives the cap lifting device 70. The present teaching, however, is not limited thereto. For example, a motor different from the ASF motor, such as the PF motor 101, may drive the cap lifting device 70.

The configuration of the cap lifting device moving the nozzle cap 61 upward and downward is not limited to the configuration of the cap lifting device 70 in the above embodiment. A device having a configuration different from that of the cap lifting device 70 may move the nozzle cap 61 upward and downward.

Figure 21:
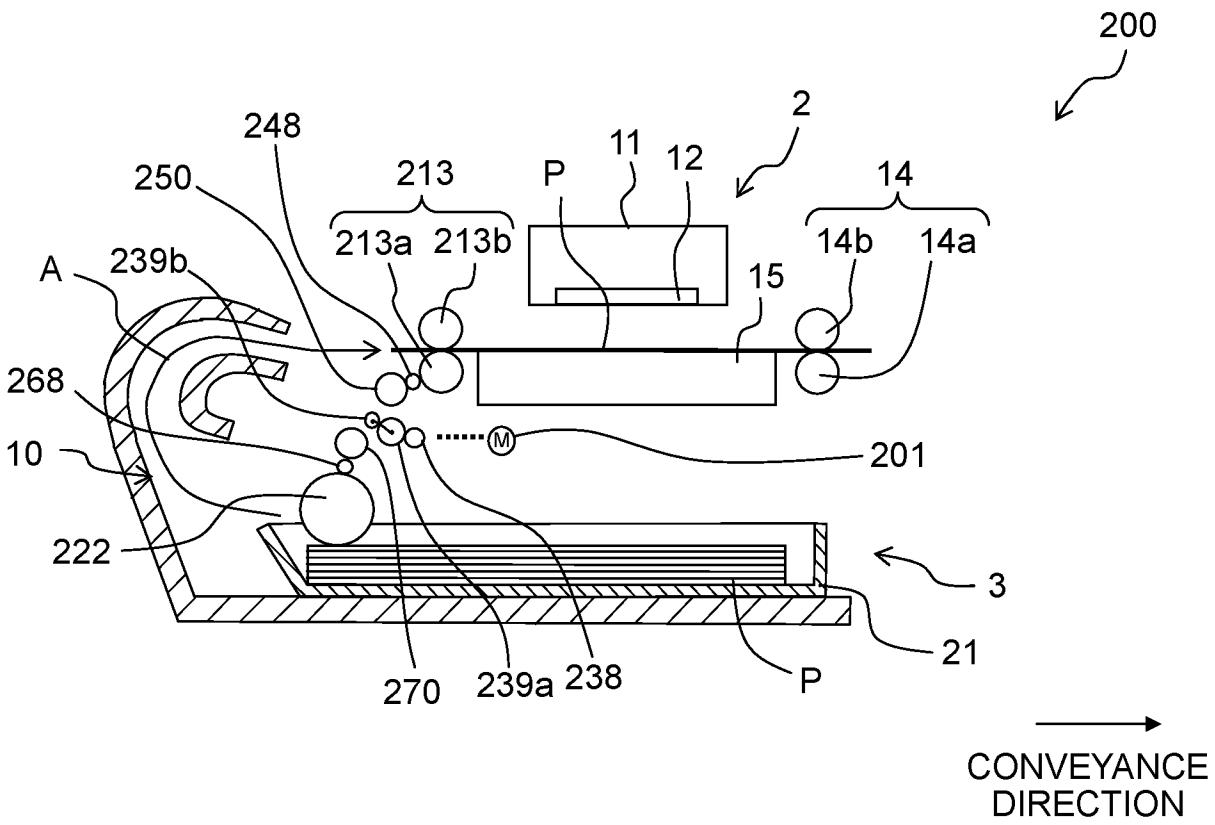
FIG. 21 is a schematic side view of a printer according to a sixth modified example.

As depicted in FIG. 21, a printer 200 of a sixth modified example includes a feed roller 222 (a "feeder" of the present teaching) feeding the recording sheet P accommodated in the sheet cassette 21 as well as a drive roller 213*a* (a "conveyer" of the present teaching) and a driven roller 213*b* that nip the recording sheet P fed from the feed roller 222 therebetween. A motor 201 drives both of the feed roller 222 and the drive roller 213*a*. The motor 201 is connected to an intermediate gear 238, and power from the motor 201 is transmitted to the intermediate gear 238. The intermediate gear 238 is engaged with a sun gear 239*a*, and the sun gear 239*a* is engaged with a planet gear 239*b*. The drive roller 213*a* is connected to a roller drive gear 250 via the intermediate gear 248, and the feed roller 222 is connected to a feed drive gear 270 via the intermediate gear 268. The roller drive gear 250 is disposed above the feed drive gear 270, and the roller drive gear 250 and the feed drive gear 270 are disposed to sandwich the planet gear 239*b* in an up-down direction. The planet gear 239*b* is movable in the up-down direction. The planet gear 239*b* moves upward to engage with the roller drive gear 250, and the planet gear 239*b* moves downward to engage with the feed drive gear 270. The motor 201 and the intermediate gear 238 may be configured such that power is transmitted to them via gears. In FIG. 21, illustration of the configuration between the motor 201 and the intermediate gear 238 is omitted.

The coefficient of dynamic friction of the planet gear 239*b* against the roller drive gear 250 is greater than the coefficient of dynamic friction of the planet gear 239*b* against the feed drive gear 270. In particular, the roller drive gear 250 is made of the synthetic resin material containing glass fiber as described above. Meanwhile, the planet gear 239*b* and the feed drive gear 270 are made of the synthetic resin material containing no glass fiber, such as polyacetal resin.

For example, when the printer 200 receives a printing data that is large in data size from a PC, a tablet, or the like and performs printing, the printer 200 may come into a standby state during printing because of reception of the printing data. In that case, in order to restart the printing quickly after the printer 200 finishes reception of necessary printing data, it is preferred that the motor 201 and the drive roller 213*a* be maintained in a state where power can be transmitted to them. In the printer 200, the planet gear 239*b* is positioned below the roller drive gear 250 due to the layout or arrangement of the drive roller 213*a* and the feed roller 222. This might cause disengagement of the planet gear 239*b* from the roller drive gear 250, for example, when the printer 200 has vibration. In the printer 200, however, the planet gear 239*b* is made of the synthetic resin material containing glass fiber, thus increasing the coefficient of dynamic friction of the planet gear 239*b* against the roller drive gear 250. This makes it harder for the planet gear 239*b* to disengage from the roller drive gear 250.

When the recording sheet P is conveyed, the planet gear 239*b* can be switched to engage with the roller drive gear 250 quickly after the feed roller 222 is driven with the planet gear 239*b* and the feed drive gear 270 engaged with each other. The feed drive gear 270 is positioned below the planet gear 239*b*, and thus disengagement of the planet gear 239*b* from the feed drive gear 270 is not caused accidentally. When printing for a printing data that is large in data size is performed, a part of the recording sheet P is typically positioned below the ink-jet head 12. This means that the feed roller 222 is less likely to be used at the time of restart of the printing. Thus, the feed drive gear 270 can disengage from the planet gear 239*b* quickly, achieving quick switching of power transmission in printing.

In the sixth modified example, only the roller drive gear 250 is made of the synthetic resin material containing glass fiber. The present teaching, however, is not limited thereto. For example, both of the roller drive gear 250 and the planet gear 239*b* may be made of the synthetic resin material containing glass fiber, and the feed drive gear 270 may be made of the synthetic resin material containing no glass fiber.

Figure 22:
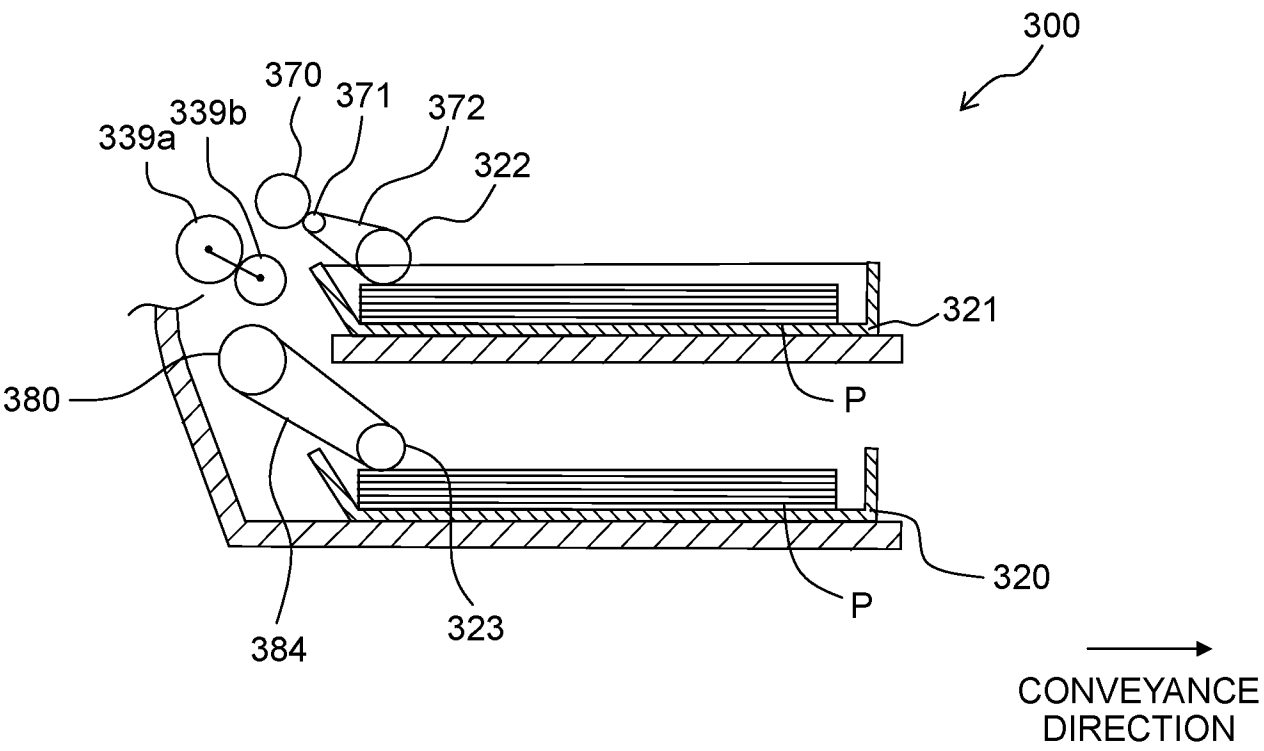
FIG. 22 is a schematic side view of a printer according to a seventh modified example.

As depicted in FIG. 22, a printer 300 of a seventh modified example includes two sheet cassettes 320, 321 that are disposed in parallel in an up-down direction to accommodate recording sheets P. The recording sheet P is fed from the sheet cassette 320 by the feed roller 323 (a "second feeder" of the present teaching), and the recording sheet P is fed from the sheet cassette 321 by the feed roller 322 (a "first feeder" of the present teaching). In the printer 300, the PF motor 101 selectively drives the feed roller 322 and the feed roller 323. The feed roller 322 is connected to a feed drive gear 370 via a belt 372 and an intermediate gear 371. The feed roller 323 is connected to a feed drive gear 380 via a belt 384. The feed drive gear 370 is disposed above the feed drive gear 380. The printer 300 includes a sun gear 339*a* to be driven by the PF motor 101 and a planet gear 339*b* engaged with the sun gear 339*a*. The planet gear 339*b* is positioned between the feed drive gear 370 and the feed drive gear 380 in the up-down direction. When the recording sheet P is fed from the sheet cassette 321, the PF motor 101 is driven to drive the feed roller 322 in a state where the planet gear 339*b* is engaged with the feed drive gear 370. When the recording sheet P is fed from the sheet cassette 320, the PF motor 101 is driven to drive the feed roller 323 in a state where the planet gear 339*b* is engaged with the feed drive gear 380. FIG. 22 depicts only some parts of the printer 300, and illustration of the constitutive parts or components, which are the same as or equivalent to those of the embodiment described above, is omitted. Although not depicted in FIG. 22, for example, the feed drive gears 370 and 380 may be disposed not to overlap with each other in the scanning direction in order to prevent the gears 370 and 380 from interfering with the recording sheet P. Or, it is allowable to provide, for example, ribs forming a conveyance route of the recording sheet P, as appropriate.

For example, when the printer 300 is designed such that, of the two sheet cassettes 320 and 321, the sheet cassette 321 is used as a standard cassette, the feed drive gear 370 to be connected to the feed roller 322 is made of the synthetic resin material containing glass fiber. The planet gear 339*b* and the feed drive gear 380 are made of the synthetic resin material containing no glass fiber.

Thus, the coefficient of dynamic friction of the planet gear 339*b* against the feed drive gear 370 is greater than the coefficient of dynamic friction of the planet gear 339*b* against the feed drive gear 380. This makes it easier to maintain engagement between the planet gear 339*b* and the feed drive gear 370 when the printer 300 is in a standby state in which no printing is performed.

In the seventh modified example, only the feed drive gear 370 is made of the synthetic resin material containing glass fiber. The present teaching, however, is not limited thereto. For example, both of the planet gear 339*b* and the feed drive gear 370 may be made of the synthetic resin material containing glass fiber, and the feed drive gear 380 may be made of the synthetic resin material containing no glass fiber.

The above description explains the examples in which the nozzle cap makes contact with the ink jetting surface to cover the nozzles in the capping position. The present teaching, however, is not limited thereto. Provided that the nozzle cap can cover the nozzles, the nozzle cap may make contact with other part than the ink jetting surface in the capping position.

The above description explains the examples in which the present teaching is applied to the printer that discharges ink from nozzles to perform printing on the recording sheet. The present teaching, however, is not limited thereto. The present teaching may be applied, in addition to the printer, to liquid jetting apparatuses jetting liquid other than ink.

The above description explains the examples in which the present teaching is applied to the printer. The present teaching, however, is not limited thereto. The present teaching may be applied to any other apparatus, provided that it includes a power transmission mechanism that selectively drives one motor and two driven targets.

What is claimed is:

1. A liquid jetting apparatus, comprising:

a head unit having a liquid jetting surface with nozzles;

a cap configured to cover the nozzles in a state of being in contact with the head unit;

a cap lifter configured to move the cap between a capping position in which the cap is in contact with the head unit to cover the nozzles and an uncapping position in which the cap is separated from the head unit;

a motor;

a driven device;

a first transmission gear connected to the cap lifter and configured to transmit power of the motor to the cap lifter;

a second transmission gear connected to the driven device and configured to transmit the power of the motor to the driven device; and a movement gear connected to the motor and configured to be moved between a position at which the movement gear engages with the first transmission gear and a position at which the movement gear engages with the second transmission gear depending on a rotation direction of the motor, wherein at least one of the first transmission gear and the movement gear is made of a synthetic resin material containing glass fiber.

2. The liquid jetting apparatus according to claim 1, further comprising a guide part configured to guide the movement gear, wherein the guide part is configured to guide the movement gear such that the movement gear engages with the first transmission gear from below.

3. The liquid jetting apparatus according to claim 1, further comprising a clutch gear disposed between the motor and the movement gear, the clutch gear including:

a first gear to which the power of the motor is transmitted; and a second gear which is disposed coaxially with the first gear, connected to the first gear with play in a rotation direction, and connected to the movement gear.

4. The liquid jetting apparatus according to claim 1, further comprising a controller configured to control the motor, wherein the controller is configured to:

move the cap to the capping position by rotating the motor in a direction in which the movement gear engages with the first transmission gear to transmit the power of the motor to the cap lifter, and stop the motor to maintain a state in which the movement gear engages with the first transmission gear, in a case that the cap reaches the capping position.

5. A liquid jetting apparatus, comprising:

a head unit having a liquid jetting surface with nozzles;

a cap configured to cover the nozzles in a state of being in contact with the head unit;

a cap lifter configured to move the cap between a capping position in which the cap is in contact with the head unit to cover the nozzles and an uncapping position in which the cap is separated from the head unit;

a motor;

a driven device;

a first transmission gear configured to transmit power of the motor to the cap lifter;

a second transmission gear configured to transmit the power of the motor to the driven device; and a movement gear connected to the motor and configured to be moved between a position at which the movement gear engages with the first transmission gear and a position at which the movement gear engages with the second transmission gear depending on a rotation direction of the motor, wherein a maximum friction force between the first transmission gear and the movement gear obtained in a state where the first transmission gear is engaged with the movement gear is greater than a maximum friction force between the second transmission gear and the movement gear obtained in a state where the second transmission gear is engaged with the movement gear.

6. The liquid jetting apparatus according to claim 5, wherein the first transmission gear is made of a synthetic resin material containing glass fiber, and the second transmission gear and the movement gear are made of a synthetic resin material containing no glass fiber.

7. The liquid jetting apparatus according to claim 5, wherein both of the first transmission gear and the movement gear are made of a synthetic resin material containing glass fiber.

8. The liquid jetting apparatus according to claim 7, wherein a content rate of the glass fiber in the first transmission gear is higher than a content rate of the glass fiber in the movement gear.

9. The liquid jetting apparatus according to claim 5, wherein at least the first transmission gear, among the first transmission gear and the movement gear, is made of a synthetic resin material containing glass fiber, the second transmission gear is made of the synthetic resin material containing the glass fiber, and a content rate of the glass fiber in the first transmission gear is higher than a content rate of the glass fiber in the second transmission gear.

10. A power transmission apparatus, comprising:

a motor;

a first driven device and a second driven device;

a first transmission gear connected to the first driven device and configured to transmit power of the motor to the first driven device;

a second transmission gear connected to the second driven device and configured to transmit the power of the motor to the second driven device; and a movement gear connected to the motor and configured to be moved between a position at which the movement gear engages with the first transmission gear and a position at which the movement gear engages with the second transmission gear depending on a rotation direction of the motor, wherein a maximum friction force between the first transmission gear and the movement gear obtained in a state where the first transmission gear is engaged with the movement gear is greater than a maximum friction force between the second transmission gear and the movement gear obtained in a state where the second transmission gear is engaged with the movement gear.

11. The power transmission apparatus according to claim 10, further comprising a guide part configured to guide the movement gear, wherein the guide part is configured to guide the movement gear such that the movement gear engages with the first transmission gear from below.

12. The power transmission apparatus according to claim 11, wherein the first transmission gear is positioned above the second transmission gear, and the guide part is positioned between the first transmission gear and the second transmission gear in an up-down direction.

13. A recording apparatus, comprising:

an accommodating part in which a recording medium is accommodated;

a feeder configured to feed the recording medium, which is accommodated in the accommodating part, from the accommodating part;

a conveyer configured to convey the recording medium fed by the feeder in a conveyance direction such that the recording medium faces a recording head configured to perform recording on the recording medium; and the power transmission apparatus as defined in claim 10, wherein the conveyer is the first driven device and the feeder is the second driven device.

14. A recording apparatus, comprising:

a first accommodating part in which a recording medium is accommodated;

a second accommodating part in which another recording medium is accommodated;

a recording head configured to perform recording on the recording medium and the another recording medium;

a first feeder configured to feed the recording medium, which is accommodated in the first accommodating part, from the first accommodating part;

a second feeder configured to feed the another recording medium, which is accommodated in the second accommodating part, from the second accommodating part; and the power transmission apparatus as defined in claim 10, wherein the first feeder is the first driven device and the second feeder is the second driven device.

15. A liquid jetting apparatus, comprising:

a head unit having a liquid jetting surface with nozzles;

a cap configured to cover the nozzles in a state of being in contact with the head unit; and the power transmission apparatus as defined in claim 10, wherein the first driven device is a cap lifter configured to move the cap between a capping position in which the cap is in contact with the head unit to cover the nozzles and an uncapping position in which the cap is separated from the head unit, and at least one of the first transmission gear and the movement gear is made of a synthetic resin material containing glass fiber.

16. A liquid jetting apparatus, comprising:

a head unit having a liquid jetting surface with nozzles;

a cap configured to cover the nozzles in a state of being in contact with the head unit; and the power transmission apparatus as defined in claim 10, wherein the first driven device is a cap lifter configured to move the cap between a capping position in which the cap is in contact with the head unit to cover the nozzles and an uncapping position in which the cap is separated from the head unit.

17. The power transmission apparatus according to claim 10, further comprising a clutch gear disposed between the motor and the movement gear, the clutch gear including: a first gear to which the power of the motor is transmitted; and a second gear which is disposed coaxially with the first gear, connected to the first gear with play in a rotation direction, and connected to the movement gear.

18. The liquid jetting apparatus according to claim 16, further comprising a controller configured to control the motor, wherein the controller is configured to:

move the cap to the capping position by rotating the motor in a direction in which the movement gear engages with the first transmission gear to transmit the power of the motor to the cap lifter, and stop the motor to maintain a state in which the movement gear engages with the first transmission gear, in a case that the cap reaches the capping position.

* * * * *